US006453555B1

(12) United States Patent
Kato et al.

(10) Patent No.: US 6,453,555 B1
(45) Date of Patent: Sep. 24, 2002

(54) METHOD OF PRODUCING COMPRESSOR PISTON

(75) Inventors: Takayuki Kato; Seiji Katayama, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/666,523

(22) Filed: Sep. 20, 2000

(30) Foreign Application Priority Data

Sep. 21, 1999 (JP) ..... 11-267121
Jun. 29, 2000 (JP) ..... 2000-196494

(51) Int. Cl.[7] ..... B23P 15/00
(52) U.S. Cl. ..... 29/888.044
(58) Field of Search ..... 29/888.044, 888.043, 29/888.042, 527.5

(56) References Cited

U.S. PATENT DOCUMENTS 4,404,262 A * 9/1983 Watmough ..... 29/888.044
5,174,728 A 12/1992 Kimura et al. ..... 417/222.2
5,992,015 A * 11/1999 Kurita et al. ..... 29/888.042
6,266,878 B1 * 7/2001 Durkin et al. ..... 29/888.043

FOREIGN PATENT DOCUMENTS

JP A-9-256952 9/1997

* cited by examiner

*Primary Examiner*—I Cuda Rosenbaum
(74) *Attorney, Agent, or Firm*—Woodcock Washburn LLP

(57) ABSTRACT

A method of producing a piston for a compressor, including the steps of casting a molten material into a die to form a hollow cylindrical head portion of the piston that is open at one of opposite ends thereof and is closed at the other end thereof, such that an amount of gas included in the material of the head portion is not more than 5 cc per 100 g of the material, closing, with a closure member, the open end of the head portion, and welding the head portion and the closure member to each other by emitting, a plurality of times, a welding beam toward each of a multiplicity of spots on a welding line along which the head portion and the closure member contact each other.

16 Claims, 14 Drawing Sheets

FIG. 13

| TIMES | ELECTRON BEAM CURRENT(mA) | ELECTRON BEAM SPEED(m/min) |
|---|---|---|
| 1 | 50 | 5 |
| 2 | 50 | 7 |
| 3 | 50 | 9 |
| 4 | 50 | 11 |
| 5 | 50 | 11 |

FIG. 15

| TIMES | ELECTRON BEAM CURRENT(mA) | ELECTRON BEAM SPEED(m/min) |
|---|---|---|
| 1 | 50 | 5 |
| 2 | 40 | 5 |
| 3 | 30 | 5 |
| 4 | 20 | 5 |
| 5 | 20 | 5 |

METHOD OF PRODUCING COMPRESSOR PISTON

BACKGROUND OF THE INVENTION

1. Field of the Invention

The present invention relates in general to a method of producing a piston for a compressor which compresses a gas, and more particularly to a method of producing such a piston having a hollow cylindrical head portion which is slidably fitted in a cylinder bore formed in a cylinder block of the compressor.

2. Discussion of the Related Art

A piston used for a compressor is reciprocated within a cylinder bore formed in a cylinder block of the compressor. In view of this, it is desirable to reduce the weight of the piston. When the piton is used for a swash plate type compressor, in particular for a variable capacity type swash plate compressor, it is particularly required to reduce its weight. As the swash plate type compressor for compressing a refrigerant gas used in an air conditioning system of an automotive vehicle, the above-described variable capacity type swash plate compressor has been recently used, wherein the angle of inclination of the swash plate with respect to a plane perpendicular to the axis of rotation of the drive shaft is variable to change the discharge capacity of the compressor. In the swash plate type compressor for the vehicle, it is generally required to increase a rotation speed of the drive shaft for thereby attaining an improved operating performance of the compressor, so as to meet the demand for reducing the size of the compressor. To this end, it is necessary to reduce the weight of the piston. In the variable capacity type swash plate compressor wherein the angle of inclination of the swash plate is adjusted on the basis of a difference between the pressures in a compressing chamber which is partially defined by the piston, and a crank chamber in which the swash plate is disposed, it is particularly required to reduce the weight of the piston for achieving a stable adjustment of the inclination angle of the swash plate and reducing the noise of the compressor during its operation.

The assignee of the present invention proposes, in the Japanese Patent Publication No. 9-105380 and its corresponding U.S. Pat. No. 5,174,728, a technique of reducing the weight of the piston used for the variable capacity type swash plate compressor. Namely, the piston having a hollow head portion which is slidably fitted in the cylinder bore is produced, by first preparing a hollow cylindrical head member having an open end and a closed end, then closing the open end of the head member by a closure member which is formed integrally with an engaging portion which engages the swash plate, and finally welding the head member and the closure member together. The head member and the closure member are both formed by forging.

The formation of the head member and the closure member by forging inevitably pushes up a cost of manufacture of the piston. To reduce the cost, the piston with a hollow head portion is formed by die-casting. In the die-cast piston, however, it is difficult to weld the head member and the closure member to each other, and this problem makes the die-cast piston unsuitable for practical use. Further, it is desirable to reduce the weight of the piston in other types of the compressor such as a fixed capacity type as well as the variable capacity type.

SUMMARY OF THE INVENTION

It is therefore an object of the present invention to provide a method of producing a piston for a compressor, wherein at least a hollow cylindrical head portion of the piston is formed by die-casting and a closure member is welded to the hollow cylindrical head portion.

The above object may be achieved according to any one of the following forms or modes of the present invention, each of which is numbered like the appended claims and depends from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) According to a first feature of the present invention, there is provided a method of producing a piston for a compressor, comprising the steps of casting a molten material into a die to form a hollow cylindrical head portion of the piston that is open at one of opposite ends thereof and is closed at the other end thereof, such that an amount of gas included in the material of the head portion is not more than 5 cc per 100 g of the material; closing, with a closure member, the open end of the head portion; and welding the head portion and the closure member to each other by emitting, a plurality of times, a welding beam toward each of a multiplicity of spots on a welding line along which the head portion and the closure member contact each other.

In the present production method, it is desirable that the closure member be also formed by die-casting. However, this is not essentially required. The piston may include an engaging portion which is integrally formed with the closed end of the hollow cylindrical head portion and which engages a drive mechanism, and the closure member may be a cover member which just closes the open end of the head portion. In this particular case, the cover member may be produced by a method other than the die-cast method; such as machining of a commercially available common material, such as a bar-like material, or forging. It is desirable that the head portion and the closure member be formed of an aluminum alloy that has a small specific gravity and is easily die-cast. However, the head portion and the closure member may be formed of a different material such as a magnesium alloy.

In a conventional die-cast piston, the amount of gas included in the material of the hollow cylindrical head portion of the piston is 10 to 30 cc per 100 g of,the material under normal condition, i.e., one atmospheric pressure and room temperature. In contrast thereto, in a piston produced by a special die-cast, such as pore-free method or forging cast method, described later, the amount of gas included in the material of the hollow cylindrical head portion of the piston can be lowered to 5 cc per 100 g of the material udder the normal condition. The open end of the head portion is closed with the closure member, and the head portion and the closure member are welded to each other by emitting a welding beam, two or more times, toward each of a number of spots on a welding line along which the head portion and the closure member contact each other, so that respective welded portions of the head portion and the closure member have only a small amount of blowholes. The thus produced piston is suitable for practical use. The welding beam, such as an electronic beam or a laser beam, may be emitted to form a beam spot on the welding line, and one of the welding beam and the combination of the head portion and the closure member may be rotated relative to the other to move the beam spot on the welding line. Thus, respective welding portions of the head portion and the closure member, in the vicinity of the welding line, are molten and bonded to each other. At this Time, the gas included in the material of the members are heated and expanded to run away into the atmosphere, so that blowholes are produced in the welding beads. However, since the amount of pas included in the material is at the low level of not more than 5 cc per 100 g of the material, the amount of the blowholes produced is also at a low level. In addition, the blowholes which arc once produced in the welding beads are closed when the welding beads are subjected to another exposure to the welding beam and are molten, so that the welding beads have a still less amount of blowholes. The thus produced die-cast piston is highly suitable for practical use The phrase of "emitting, a plurality of times, a welding beam toward each of a multiplicity of spots on a welding line" is defined as meaning emitting, a plurality of times, a welding beam to each of a multiplicity of points on a welding line or the vicinity of the each point. That is, according to the present invention, it is not required to emit, a plurality of times, a welding beam to, strictly, each of a multiplicity of points on a welding line, but it is possible to emit, for the first time, a welding beam to each of a multiplicity of points on a welding line and, for the second time, the welding beam or another welding beam to substantially the same point as the each point.

According to the present feature, the amount of gas included in the material of the head portion is not more than 5 cc per 100 g of the material, more preferably not more than 3 cc per 100 g of the material, most preferably not more than 1 cc per 100 g of the material.

(2) According to a second feature of the present invention that includes the first feature (1), the step of casting the molten material comprises casting the molten material in a pore-free die-cast method.

The pore-free die-cast method is defined as a casting method in which a molten metal such as an aluminum alloy is cast into a cavity of a die (e.g., a movable die and a stationary die) in the state in which the cavity is filled with an active gas such as oxygen and, since a high degree of vacuum is produced in the cavity because of the reaction of the molten metal and the active gas, the gas is prevented from being included or involved into the material of the cast product. The cast product enjoys a high strength even if the thickness of wall thereof may be small.

(3) According to a third feature of the present invention that includes the first feature (1), the step of casting the molten material comprises casting the molten material in a forging-cast method.

The forging-cast method is defined as a casting method in which a high pressure, e.g., 30 to 200 MPa, is applied to a fully or half molten metal which has been cast in a die and this state is kept until the molten metal is solidified. This method can reduce the amount of gas that is included or involved into the material of the cast product.

(4) According to a fourth feature of the present invention that includes any one of the first to third features (1) to (3), the step of welding the head portion and the closure member comprises welding the head portion and the closure member to each other by emitting each of a plurality of welding beams toward the each of the spots on the welding line while moving at least one of the each of the welding beams and a combination of the head portion and the closure member relative to the other of the each of the welding beams and the combination, so that the each of the spots is exposed to the each of the welding beams.

In the welding step according to the fourth feature (4), at least one of (a) the respective proportions of respective intensities of the plurality of welding beams and (b) the distance between the plurality of welding beams (e.g., two welding beams) may be so changed that in the state in which the welding beads which are produced by a prior one of the welding beams have been solidified to an appropriate degree, the welding beams are exposed to a subsequent one of the welding bees. Once the proportion of intensity of each of the welding beams is determined, it is possible to determine an appropriate speed at which the each welding beam is moved to melt appropriately the metal materials on both sides of the welding line. Meanwhile, in order to eliminate appropriately the blowholes, it is desirable, as indicated above, that in the state in which the welding beads which are produced by a prior one of the welding beams have been solidified to an appropriate degree, the welding beams are exposed to a subsequent one of the welding beams. To meet both of those requirements, it is effective to change at least one of (a) the respective proportions of respective intensities of the plurality of welding beams and (b) the distance between the plurality of welding beams.

(5) According to a fifth feature of the present invention that includes the fourth feature (4), the step of emitting the each of the welding beams comprises oscillating at least one of the welding beams, relative to the welding line, while moving the one welding beam relative to the combination.

It is otherwise possible to move simply at least one of the welding beams relative to the combination. However, it is effective to oscillate at least one of the welding beams, relative to the welding line, in order to eliminate the blowholes and/or increase the strength of the welding.

(6) According to a sixth feature of the present invention that includes the fifth feature (5), the step of oscillating the one welding beam comprises rotating the one welding beam so as to describe a conical surface.

At least one of the welding beans may be moved along the welding line relative to the combination while being iteratively rotated to describe a conical surface. In this case, the welding spot formed by the one welding spot formed by the one welding beam describes a locus, shown in FIG. 8, along the welding line, so that the amount of blowholes is reduced. It is speculated that this effect would result from the fact that each of the welding beads is molten two or more times.

(7) According to a seventh feature of the present invention that includes any one of the first to third features (1) to (3), the step of welding the head portion and the closure member comprises welding the head portion and the closure member to each other by emitting at least one welding beam toward the each of the spots on the welding line while moving at least one of the one welding beam and a combination of the head portion and the closure member relative to the other of the one welding beam and the combination, so that the each of the spots is exposed, the plurality of times, to the one welding beam.

(8) According to an eighth feature of the present invention that includes the seventh feature (7), the step of emitting the one welding beam comprises oscillating the one welding beam relative to the welding line while moving the one welding beam relative to the combination.

(9) According to a ninth feature of the present invention that includes any one of the first to eighth features (1) to (8), the step of welding the head portion and the closure member comprises welding the head portion and the closure member to each other under a predetermined welding condition which assures that respective portions of the head portion and the closure member that are molten by the welding beam at a last time of the plurality of times are contained in a sum of respective portions of the head portion and the closure member that are molten by the welding beam at each time of the plurality of times that is prior to the last time. The phrase "sum of respective portions of the head portion and the closure member that are molten by the welding beam at each time of the plurality of times that is prior to the last time" means any portion of the head portion and the closure member that has been molten at least one time prior to the last time. For example, in the case where the position of the center of the welding spot formed by the welding beam emitted at a second time differs from that at a first time, the portion molten at the second time may be offset from the portion molten at the first time, in a direction perpendicular to the welding line. If the portion or portions molten at the last time is or are fully contained in the sum of the portions molten at the first and second times, the predetermined welding condition according to the ninth feature (9) is satisfied. In other words, at the last time, the welding beam must not melt any new portion of the head portion or the closure member.

(10) According to a tenth feature of the present invention that includes the ninth feature (9), the predetermined welding condition assures that respective portions of the head portion and the closure member that are molten by the welding beam at each subsequent time of the plurality of times are contained in respective portions of the head portion and the closure member that are molten by the welding beam at each prior time of the plurality of times that is prior to the each subsequent time.

In the welding step according to the tenth feature (10), the welding beam emitted at each time subsequent to the first time does not melt any new portion of the head portion and the closure member. That is, the portion or portions molten at each subsequent time coincides with, or are smaller than, the portion or portions molten at each prior time. If the time duration between two successive times is short, the temperature of the respective portions of the head portion and the closure member that are molten at the prior or first time is usually still high when those portions are exposed to the welding beam at the subsequent or second time. Therefore, if the subsequent exposure is effected under the same condition as that under which the prior exposure is effected, the predetermined welding condition according to the tenth feature is not satisfied. That is, the condition for the subsequent time must be more moderate than that for the prior time.

(11) According to an eleventh feature of the present invention that includes the ninth or tenth feature (9) or (10), the predetermined welding condition assures that respective portions of the head portion and the closure member that are molten by the welding beam at the last time are contained in respective portions of the head portion and the closure member that are molten by the welding beam at a first time of the plurality of times that is prior to the last time.

(12) According to a twelfth feature of the present invention that includes any one of the ninth to eleventh features (9) to (11), the step of welding the head portion and the closure member to each other comprises emitting, at least three times including at least one time between a first time and the last time, the welding beam toward the each of the spots on the welding line, and wherein the predetermined welding condition assures that respective portions of the head portion and the closure member that are molten by the welding beam at each of the at least one time are contained in respective portions of the head portion and the closure member that are molten by the welding beam at the first time.

(13) According to a thirteenth feature of the present invention that includes any one of the ninth to twelfth features (9) to (12), the predetermined welding condition assures that respective portions of the head portion and the closure member that are molten by the welding beam at the last time coincide with respective portions of the head portion and the closure member that are molten by the welding beam at least one time of the plurality of times that precedes the last time. So long as the present feature is concerned, there are no times between the one time that precedes the last time, and the last time.

(14) According to a fourteenth feature of the present invention that includes any one of the ninth to thirteenth features (9) to (13), the predetermined welding condition comprises that a speed at which at least one of the welding beam and a combination of the head portion and the closure member is moved relative to the other of the welding beam and the combination, at the last time, is equal to a speed at which the one of the welding beam and the combination is moved relative to the other of the welding beam and the combination, at least one time of the plurality of times that precedes the last time, and that an intensity with which the welding beam is emitted at the last time is equal to an intensity with which the welding beam is emitted at the at least one time.

(15) According to a fifteenth feature of the present invention that includes any one of the ninth to fourteenth features (9) to (14), the predetermined welding condition assures that respective portions of the head portion and the closure member that are molten by the welding beam at each subsequent time of the plurality of times are contained in respective portions of the head portion and the closure member that are molten by the welding beam in each prior time of the plurality of times that is prior to the each subsequent time, and the predetermined welding condition comprises at least one of (a) that a speed at which at least one of the welding beam and a combination of the head portion and the closure member is moved relative to the other of the welding beam and the combination, at the each subsequent time, is not lower than a speed at which the one of the welding beam and the combination is moved relative to the other of the welding beam and the combination, at the each prior time, and (b) that an intensity with which the welding beam is emitted at the each subsequent time is not higher than an intensity with which the welding beam is emitted at the each prior time.

The phrase "not lower than" means both the case of —equal to—and the case of—higher than—, but the case of —higher than—is preferable to the case of—equal to—. Similarly, the phrase "not higher than" means both the case of—equal to—and the case of—lower than—, but the case of—lower than—is preferable to the case of—equal to—.

The phrase "each subsequent time" used in the fifteenth feature (15) means, for example, the last time used in the ninth or eleventh feature (9) or (11), all times subsequent to the first time, used in the tenth feature (10), or the last time and the at least one time between the first and last times, used in the twelfth feature (12). The "each prior time" used in the feature (15) means, for example, all times prior to the last time, used in the ninth or tenth feature (9) or (10), or the first time used in the eleventh or twelfth feature (11) or (12). That is, the phrase "each subsequent time" may mean a subsequent one of each pair of successive times, and the phrase "each prior time" may mean a prior one of each pair of successive times. In addition, the phrase "each subsequent time" may mean one or more times subsequent to a certain time, and the phrase "each prior time" may mean one or more times prior to a certain time. These are true with the sixteenth feature (16) described below.

(16) According to a sixteenth feature of the present invention that includes any one of the ninth to fifteenth features (9) to (15), the predetermined welding condition assures that respective portions of the head portion and the closure member that are molten by the welding beam at each subsequent time of the plurality of times are contained in respective portions of the head portion and the closure member that are molten by the welding beam at each prior time of the plurality of times that is prior to the each subsequent time, and the predetermined welding condition comprises that an amount of oscillation of the welding beam relative to the welding line at the each subsequent time is less than an amount of oscillation of the welding beam relative to the welding line at the each prior time.

BRIEF DESCRIPTION OF THE DRAWINGS

The above and optional objects, features, advantages of the present invention will be better understood and appreciated by reading the following detailed description of the preferred embodiments of the invention when considered in connection with the accompanying drawings, in which:

FIG. 13 is a table showing a predetermined welding condition employed in,the welding step;

FIG. 15 is a table showing another predetermined welding condition employed in a welding step of another compressor-piston producing method as a fourth embodiment of the present invention;

DETAILED DESCRIPTION OF PREFERRED EMBODIMENTS

Referring to the accompanying drawings, there will be described preferred embodiments of the present invention as applied to a single-headed piston for a swash plate type compressor used for an air conditioning system of an automotive vehicle.

Figure 1:
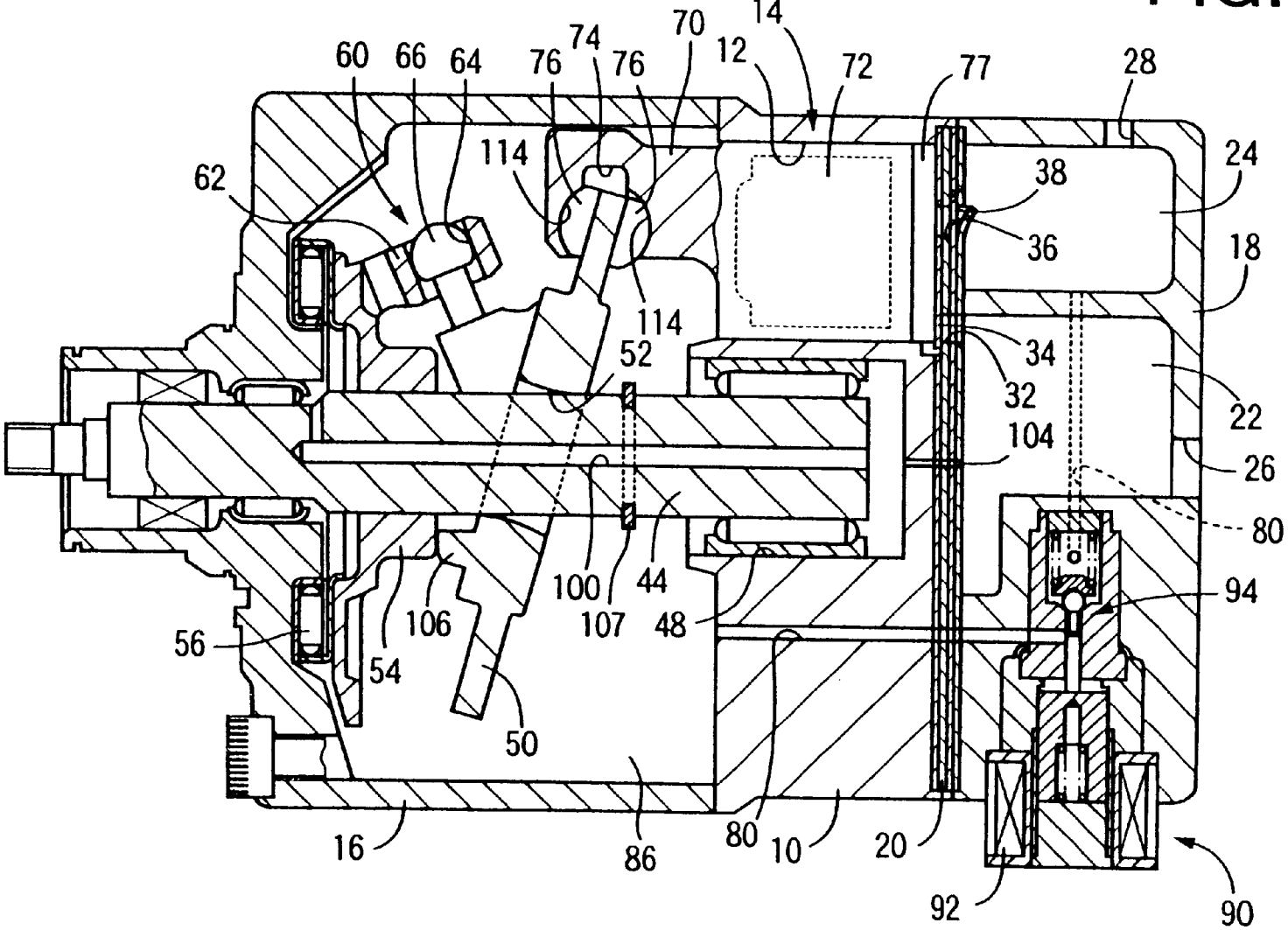
FIG. 1 is a front elevational view in cross section of a swash plate type compressor equipped with a piston produced by a method as one embodiment of the present invention.

Referring first to FIG. 1, there is shown a compressor of swash plate type incorporating a plurality of single-headed pistons (hereinafter referred to simply as "pistons") each constructed according to one embodiment of the present invention.

In FIG. 1, reference numeral 10 denotes a cylinder block having a plurality of cylinder bores 12 formed so as to extend in its axial direction such that the cylinder bores 12 are arranged along a circle whose center lies on a centerline of the cylinder block 10. The piston generally indicated at 14 is reciprocably received in each of the cylinder bores 12. To one of the axially opposite end faces of the cylinder block 10 (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor. The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 32, suction valves 34, discharge ports 36 and discharge valves 38.

A rotary drive shaft 44 is disposed in the cylinder block 10 and the front housing 16 such that the axis of rotation of the drive shaft 44 is aligned with the centerline of the cylinder block 10. The drive shaft 44 is supported at its opposite end portions by the front housing 16 and the cylinder block 10, respectively, via respective bearings. The cylinder block 10 has a central bearing hole 48 formed in a central portion thereof, and the bearing is disposed in this central bearing hole 48, for supporting the drive shaft 44 at its rear end portion. The front end portion of the drive shaft 44 is connected, through a clutch mechanism such as an electromagnetic clutch, to an external drive source (not shown) in the form of an engine of an automotive vehicle. In operation of the compressor, the drive shaft 44 is connected through the clutch mechanism to the vehicle engine in operation so that the drive shaft 44 is rotated about its axis.

The rotary drive shaft 44 carries a swash plate 50 such that the swash plate 50 is axially movable and tiltable relative to the drive shaft 44. The swash plate 50 has a central hole 52 through which the drive shaft 44 extends. The diameter of the central hole 52 of the swash plate 50 gradually increases in each of its axially opposite directions from the axially intermediate portion towards the axially opposite ends, and the hole 52 has a vertically elliptical cross sectional shape at each of the axially opposite ends. To the drive shaft 44, there is fixed a rotary member 54 as a torque transmitting member, which is held in engagement with the front housing 16 through a thrust bearing 56. The swash plate 50 is rotated with the drive shaft 44 by a hinge mechanism 60 during rotation of the drive shaft 44. The hinge mechanism 60 guides the swash plate 50 for its axial and tilting motions. The hinge mechanism 60 includes a pair of support arms 62 (only one 62 is shown in FIG. 1) fixed to the rotary member 54, guide pins 66 which are formed on the swash plate 50 and which slidably engage guide holes 64 formed in the support arms 62, the central hole 52 of the swash plate 50, and the outer circumferential surface of the drive shaft 44. It is noted that the swash plate 50 constitutes a drive member for driving the pistons 14, while the rotary drive shaft 44, the drive source in the form of the vehicle engine and the torque transmitting device in the form of the hinge mechanism 60 cooperate with each other to constitute a major portion of a drive device for driving the pistons 14, together with the swash plate 50.

The piston 14 indicated above includes an engaging portion 70 engaging the swash plate 50, and a hollow head portion 72 formed integrally with the engaging portion 70 and fitted in the corresponding cylinder bore 12. The engaging portion 70 has a groove 74 formed therein, and the swash plate 50 is held in engagement with the groove 74 through a pair of hemi-spherical shoes 76. The hemi-spherical shoes 76 are held in the groove 74 such that the shoes 76 slidably engage the engaging portion 70 at their hemi-spherical surfaces and such that the shoes 76 slidably engage the radially outer portions of the opposite surfaces of the swash plate 50 at their flat surfaces. An end face of the head portion 72, a side wall of the cylinder block 10 that defines the cylinder bore 12, and the valve plate 20 cooperate with each other to define a compressing chamber 77. The configuration of the piston 14 will be described in detail.

Figure 2:
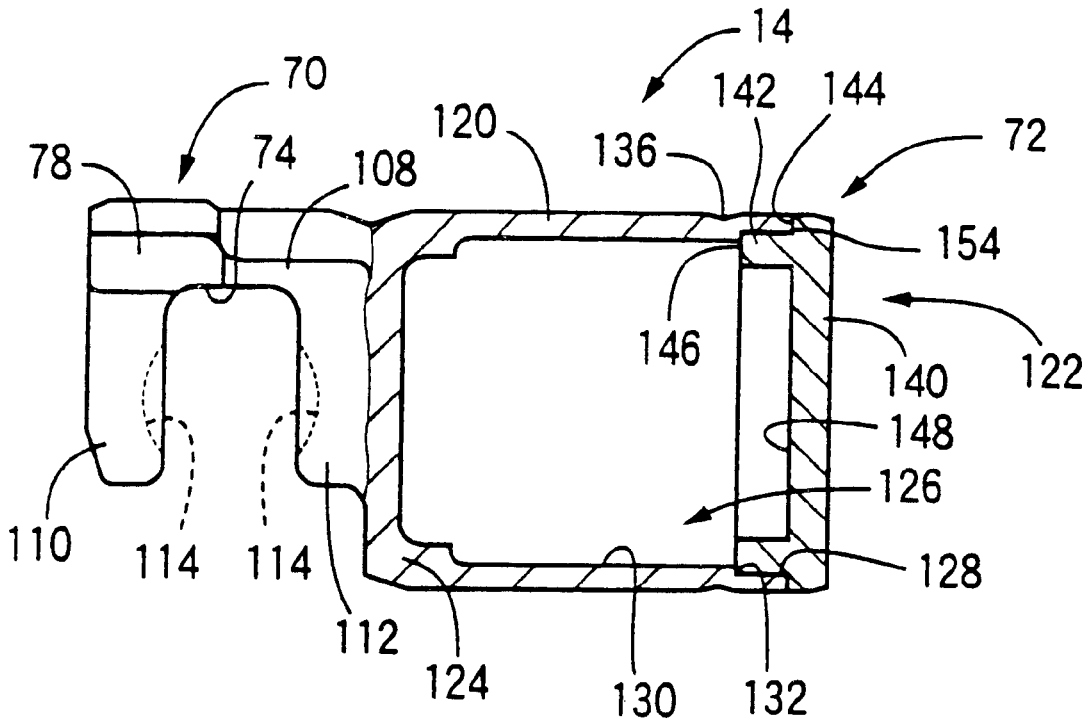
FIG. 2 is a front elevational view partly in cross section of the piston shown in FIG. 1.

A rotary motion of the swash plate 50 is converted into a reciprocating linear motion of the piston 14 through the shoes 76. A refrigerant gas in the suction chamber 22 is sucked into the compressing chamber 77 through the suction port 32 and the suction valve 34, when the piston 14 is moved from its upper dead point to its lower dead point, that is, when the piston 14 is in the suction stroke. The refrigerant gas in the compressing chamber 77 is compressed by the piston 14 when the piston 14 is moved from its lower dead point to its upper dead point, that is, when the piston 14 is in the compression stroke. The compressed refrigerant gas is discharged into the discharge chamber 24 through the discharge port 36 and the discharge valve 38. A reaction force acts on the piston 14 in the axial direction as a result of compression of the refrigerant gas in the compressing chamber 79. This reaction force is received by the front housing 16 through the piston 14, swash plate 50, rotary member 54 and thrust bearing 56. As shown in FIG. 2, the engaging portion 70 of the piston 14 has an integrally formed rotation preventive part 78, which is arranged to contact the inner circumferential surface of the front housing 16, for thereby preventing a rotary motion of the piston 14 about its centerline, and a collision of the piston 14 with the swash plate 50.

The cylinder block 10 has a supply passage 80 formed therethrough for communication between the discharge chamber 24 and a crank chamber 86 which is defined between the front housing 16 and the cylinder block 10. The supply passage 80 is connected to a solenoid-operated control valve 90 provided to control the pressure in the crank chamber 86. The solenoid-operated control valve 90 includes a solenoid coil 92, and a shut-off valve 94 which is selectively closed and opened by energization and de-energization of the solenoid coil 92. Namely, the shut-off valve 94 is placed in its closed state when the solenoid coil 92 is energized, and is placed in its open state when the coil 92 is de-energized.

The rotary drive shaft 44 has a bleeding passage 100 formed therethrough. The bleeding passage 100 is open at one of its opposite ends to the central bearing hole 48, and is open to the crank chamber 86 at the other end. The central bearing hole 48 communicates at its bottom with the suction chamber 22 through a communication port 104.

The present swash plate type compressor is a variable capacity type. By controlling the pressure in the crank chamber 86 by utilizing a difference between the pressure in the discharge chamber 24 as a high-pressure source and the pressure in the suction chamber 22 as a low pressure source, a difference between the pressure ion the crank chamber 86 which acts on the front side of the piston 14 and the pressure in the compressing chamber 77 which acts on the rear side of the piston 14 is regulated to change the angle of inclination of the swash plate 50 with respect to a plane perpendicular to the axis of rotation of the drive shaft 44, for thereby changing the reciprocating stroke (suction and compression strokes) of the piston 14, whereby the discharge capacity of the compressor can be adjusted.

As described above, the pressure in the crank chamber 86 is controlled by controlling the solenoid-operated control valve 90 to selectively connect and disconnect the crank chamber 86 to and from the discharge chamber 24. Described more specifically, when the solenoid coil 92 of the solenoid-operated control valve 90 is energized, the supply passage 80 is closed, so that the pressurized refrigerant gas in the discharge chamber 24 is not delivered into the crank chamber 86. In this condition, the refrigerant gas in the crank chamber 86 flows into the suction chamber 22 through the bleeding passage 100 and the communication port 104, so that the pressure in the crank chamber 86 is lowered, to thereby increase the angle of inclination of the swash plate 50. The reciprocating stroke of the piston 14 which is reciprocated by rotation of the swash plate 50 increases with an increase of the angle of inclination of the swash plate 50, so as to increase an amount of change of the volume of the compressing chamber 77, whereby the discharge capacity of the compressor is increased. When the solenoid coil 92 is de-energized, the supply passage 80 is opened, permitting the pressurized refrigerant gas to be delivered from the discharge chamber 24 into the crank chamber 86, resulting in an increase in the pressure in the crank chamber 86, and the angle of inclination of the swash plate 50 is decreased, so that the discharge capacity of the compressor is accordingly reduced.

The maximum angle of inclination of the swash plate 50 is limited by abutting contact of a stop 106 formed on the swash plate 50, with the rotary member 54, while the minimum angle of inclination of the swash plate 50 is limited by abutting contact of the swash plate 50 with a stop 107 in the form of a ring fixedly fitted on the drive shaft 44. The solenoid coil 92 of the solenoid-operated control valve 90 is controlled by a control device not shown depending upon a load acting on the air conditioning system including the present compressor. The control device is principally constituted by a computer. In the present embodiment, the suction chamber 22, the discharge chamber 24, the supply passage 80, the crank chamber 86, the solenoid-operated control valve 90, the bleeding passage 100, the communication port 104, and the control device for the control valve 90 cooperate to constitute a major portion of a crank chamber pressure control device for controlling the pressure in the crank chamber 86, or a swash plate angle adjusting device for controlling the angle of inclination of the swash plate 50 (i.e., a discharge capacity adjusting device for adjusting the discharge capacity of the compressor).

The cylinder block 10 and each piston 14 are formed of an aluminum alloy as a sort of metal. The piston 14 is coated at its outer circumferential surface with a fluoro resin film which prevents a direct contact of the aluminum, alloy of the piston 14 with the aluminum alloy of the cylinder block 10 so as to prevent seizure therebetween, and makes it possible to minimize the amount of clearance between the piston 14 and the cylinder bore 12. The cylinder block 10 and the piston 14 is preferably formed of an aluminum silicon alloy. Other materials may be used for the cylinder block 10, the piston 14, and the coating film.

There will, next be described the configuration of the piston 14.

The end portion of the engaging portion 70 of the piston 14, which is remote from the head portion 72, has a U-shape in cross section, as shown in FIG. 2. Described in detail, the engaging portion 70 has a base section 108 which defines the bottom of the U-shape and a pair of substantially parallel arm sections 110, 112 which extend from the base section 108 in a direction perpendicular to the axis of the piston 14. The base section 108 corresponds to a circumferential portion of the piston 14 which corresponds to a radially outer portion of the cylinder block 10 when the piston 14 is fitted in the appropriate cylinder bore 12. The two opposed lateral walls of the U-shape of the end portion of the engaging portion 70 have respective recesses 114 which are opposed to each other. Each of these recesses 114 is defined by a part-spherical inner surface of the lateral wall. The pair of shoes 76 indicated above are held in contact with the opposite surfaces of the swash plate 50 at their radially outer portions and are received in the respective part-spherical recesses 114. Thus, the engaging portion 70 slidably engages the swash plate 50 through the shoes 76.

The head portion 72 of the piston 14 is formed integrally with the engaging portion 70 on the side of its arm section 112, and includes a hollow, cylindrical body portion 120 which is open on one of its opposite ends on the side remote from the arm section 112 of the engaging portion 70, and a closure member 122 fixed to the body portion 120 for closing the open end of the body portion 120. The closure member 122 may be called a cover member. The engaging portion 70 and the head portion 72 are formed integrally with each other. Namely, the arm section 112 of the engaging portion 70 and a bottom portion 124 of the body portion 120 of the head portion 72 are integral with each other. The base section 108 of the engaging portion 70 extends in a direction parallel to the centerline of the body portion 120 from a radially outer portion of the bottom portion 124 of the body portion 120, which radially outer portion is spaced a suitable distance from the centerline. The body portion 120 has an inner circumferential surface 126 which is divided into two portions, i.e., a large-diameter portion 128 on the side of its open end and a small-diameter portion 130 remote from the open end, which two portions cooperate with each other to define a shoulder 132 therebetween. In an axially end portion of the outer circumferential surface of the body portion 120 that is near to its open end, there is formed a circumferential groove 136 through which a lubricant oil flows for assuring a smooth reciprocating movement of the piston 14 in the corresponding cylinder bore 12.

The closure member 122 is a generally disc-shaped member which consists of a circular plate portion 140, and an annular fitting protrusion 142 which protrudes from one of the opposite end faces (the inner end face) of the plate portion 140 and which has a diameter smaller than that of the plate portion 140. A shoulder 144 is formed between the circular plate portion 140 and the annular fitting protrusion 142. The closure member 122 has a circular recess 148 which defines the annular fitting protrusion 142 and is open in an end face 146 of the fitting protrusion 142, so that the weight of the, closure member 122 is reduced. The closure member 122 is fitted into the inner circumferential surface 126 of the body portion 120 such that the shoulder 144 of the closure member 122 is held in abutting contact with an end face 154 of the body portion 120, and such that the end face 146 of the annular fitting protrusion 142 of the closure member 122 is held in abutting contact with the shoulder 132 formed between the large-diameter portion 128 and the small-diameter portion 130 of the inner circumferential surface 126 of the body portion 120. In this state, the outer circumferential surface of the fitting protrusion 142 of the closure member 122 engages, the inner circumferential surface of the large-diameter portion 128 of the inner circumferential surface 126 of the body portion 120. The closure member 122 is fixed to 15 the body portion 120 by an electron beam welding as a sort of beam welding. The compression reaction force which acts on the end face of the piston 14, which end face partially defines the compressing chamber 77, as a result of compression of the refrigerant gas in the chamber 77 during the compression stroke of the piston 14, is received by the welding-bonded surfaces of the end face 146 of the fitting protrusion 142 of the closure member 122 and the shoulder 132 of the body portion 120 as well as the welding-bonded surfaces of the shoulder 144 of the closure member 122 and the end face 154 of the body member 120. In FIG. 2, the thickness of the cylindrical wall of the body portion 120 is exaggerated for easier understanding.

Figure 3:
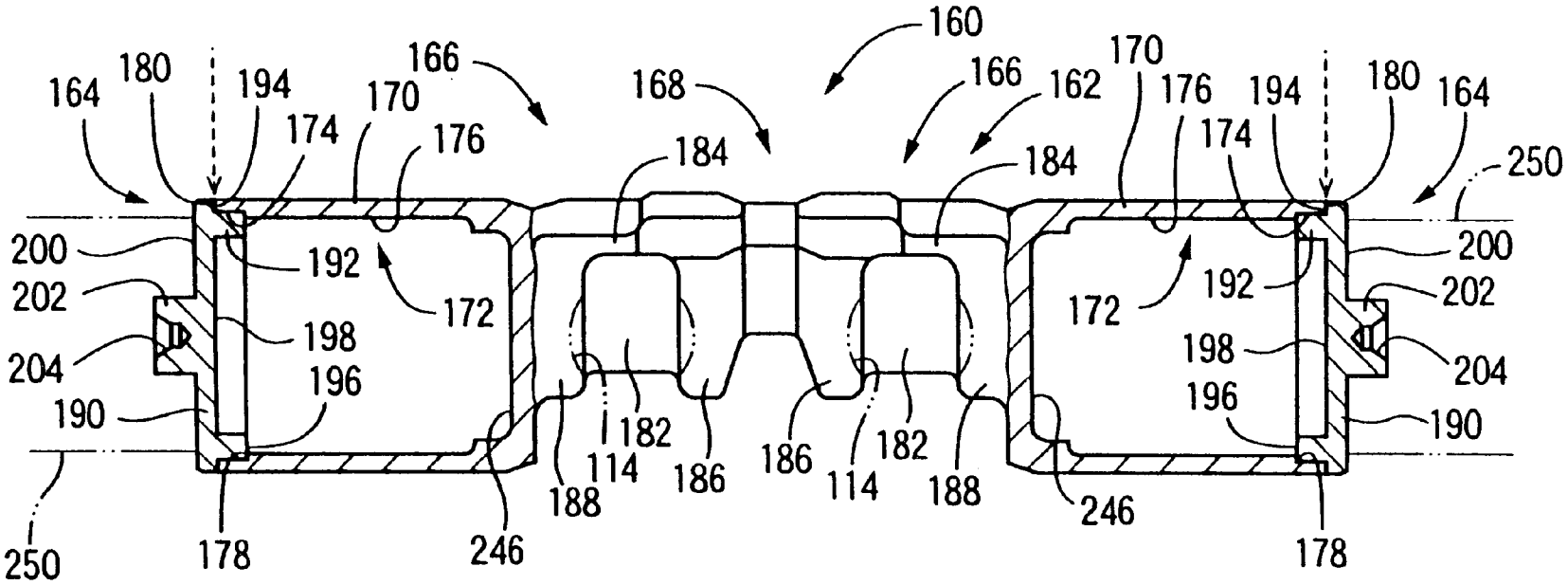
FIG. 3 is a front elevational view partly in cross section showing a body member used for manufacturing the piston of FIG. 2, after closing members are fixed to the body member.

Two pieces of the piston 14 constructed as described above are produced from a single blank 160 shown in FIG. 3. The blank 160 used for producing the two pistons 14 has a body member 162 and two closing members 164. The body member 162 consists of a twin engaging section 168 and two cylindrical hollow head sections 170 formed integrally with the twin engaging section 168 such that the two hollow head sections 170 extend from the opposite ends of the twin engaging section 168 in the opposite directions. The twin engaging section 168 consists of two engaging sections 166 which are formed in series and integrally with each other and which provide the respective two engaging portions 70 of the two single-headed pistons 14. Each of the two hollow head sections 170 is closed at one of its opposite ends which is on the side of the twin engaging section 168, and is open at the other end. The two head sections 170 are concentric with each other.

Each head section 170 of the body member 162 has an inner circumferential surface 172 which is divided into two portions, i.e., a large-diameter portion 174 on the side of its open end and a small-diameter portion 176 remote from the open end, which two portions cooperate with each other to define a shoulder 178 therebetween. The large-diameter portion 174, small-diameter portion 176, and shoulder 178 of the body member 162 respectively provide the large-diameter portion 128, small-diameter portion 130, and shoulder 132 of the piston 14. An end face 180 of the head section 170 of the body member 162 provides the end face 154 of the body portion 120 of the piston 14. For easier understanding, the wall thickness of the head section 170 is exaggerated in FIG. 3.

Each of the two engaging sections 166 includes a base section 184 functioning as the base portion 108 of the piston 14 and a pair of opposed parallel arm sections 186, 188 functioning as the arm sections 110, 112 of the piston 14. Reference numeral 182 denotes two bridge portions, each of which connects the inner surfaces of the arm sections 186, 188, in order to reinforce the engaging section 166 for increasing the rigidity of the body member 162, for improved accuracy of a machining operation on the blank 160, which is effected while the blank 160 is held at its opposite ends by chucks as described later. Each bridge portion 182 also functions as a reinforcing portion by which the body member 162 is protected from being deformed due to heat during a heat treatment of the blank 160. In the present embodiment, the body member 162 is formed by pore-free die-casting of a metallic material in the form of an aluminum alloy. This formation of the body member 162 by die-casting is a step of preparing the body member 162 which will be described in detail.

The two closing members 164 are identical in construction with each other as shown in FIG. 3. Like the closure member 122, each of the closing members 164 includes a circular plate portion 190 and an annular fitting protrusion 192 which protrudes from one of the opposite end faces (the inner end face) of the circular plate portion 190. A shoulder 194 is formed between the circular plate portion 190 and the annular fitting protrusion 192. The closing member 164 has a circular recess 198 which defines the annular fitting protrusion 192 and is open in an end face 196 of the fitting protrusion 192. The shoulder 194 and the recess 198 of the closing member 164 respectively function as the shoulder 144 and the recess 148 of the closure member 122. The circular plate portion 190 of each closing member 164 has a holding portion 202 formed at a central portion of its outer end face 200 which is opposite to the inner end face on which the annular fitting protrusion 192 is formed. The holding portion 202 has a circular shape in cross section, and has a center hole 204. In the present embodiment, the closing member 164 is formed by pore-free die-casting of a metallic material in the form of an aluminum alloy, like the body member 162. This formation of the closing members 164 by die-casting is a step of preparing the closing members 164. The circular plate portion 190 and the fitting protrusion 192 of the closing member 164 have the same dimensional relationship as the circular plate portion 140 and the fitting protrusion 142 of the closure member 122, and a detailed explanation of which is dispensed with.

In the present embodiment, the body member 162 is formed according to the pore-free die-casting method. There will be described a process of manufacturing the body member 162 shown in FIG. 4 by the pore-free die-casting method while using a die-casting device schematically shown in FIG. 5A.

The die-casting device used in the present invention includes a pair of mold halves 216, 218 which are carried by a main body of the device (not shown), and a pair of slide cores 220, 222 (indicated by a two-dot chain line in FIG. 4) which are disposed in the two mold halves 216, 218 such that the slide cores 220, 222 are slidably movable relative to the mold halves 220, 222. The two mold halves 216, 218 have respective molding surfaces 234, 236 which cooperate with the outer circumferential surfaces of the slide Cores 220, 222, to define therebetween a mold cavity 224 whose profile follows that of the body member 162. Into the mold cavity 224, a molten aluminum alloy is introduced for forming the body member 162. The mold half 216 is stationary while the mold half 218 is movable relative to the stationary mold half 216. Contact surfaces 226, 228 of the two mold halves 216, 218 define a parting plane 229 (FIG. 6), at which the two mold halves 216, 218 are butted together and are spaced apart from each other by a suitable moving device (not shown), such that the movable mold half 218 is moved toward and away from the stationary mold half 216.

Figure 4:
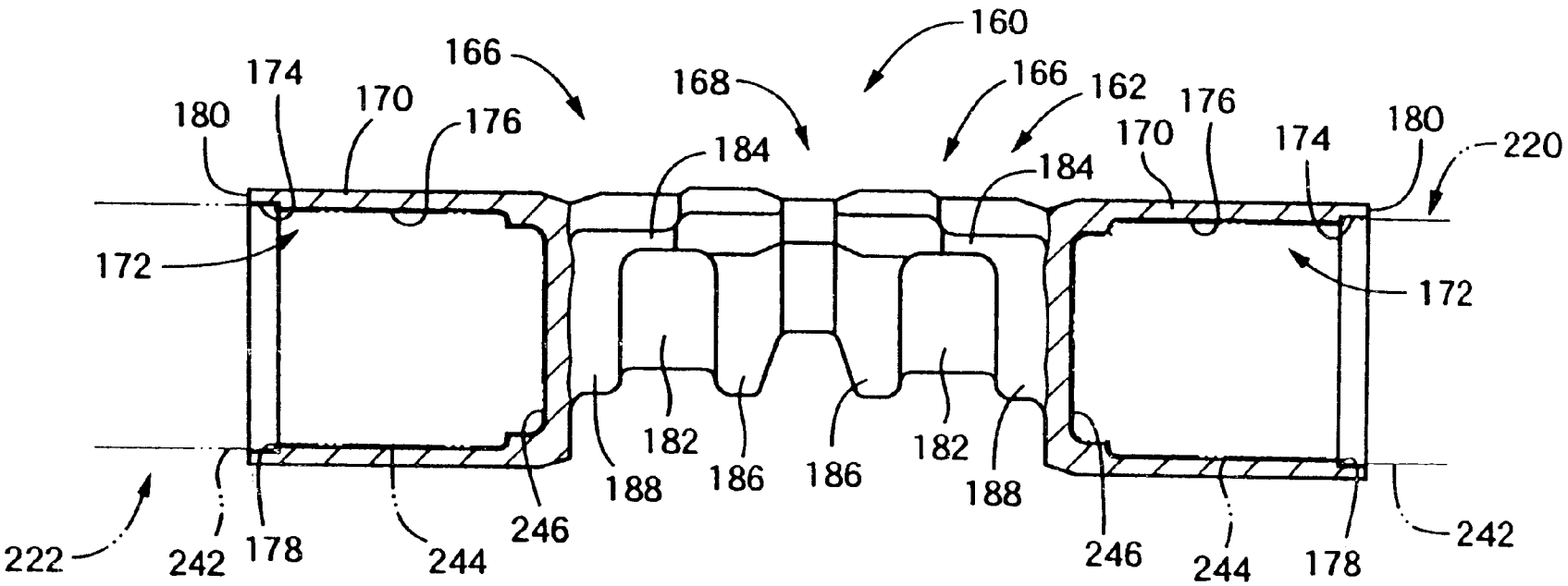
FIG. 4 is a front elevational view partly in cross section showing the body member of FIG. 3, FIGS. 5A–5C are views for explaining a process of die-casting the body member according to the method of the present invention.
Figure 6:
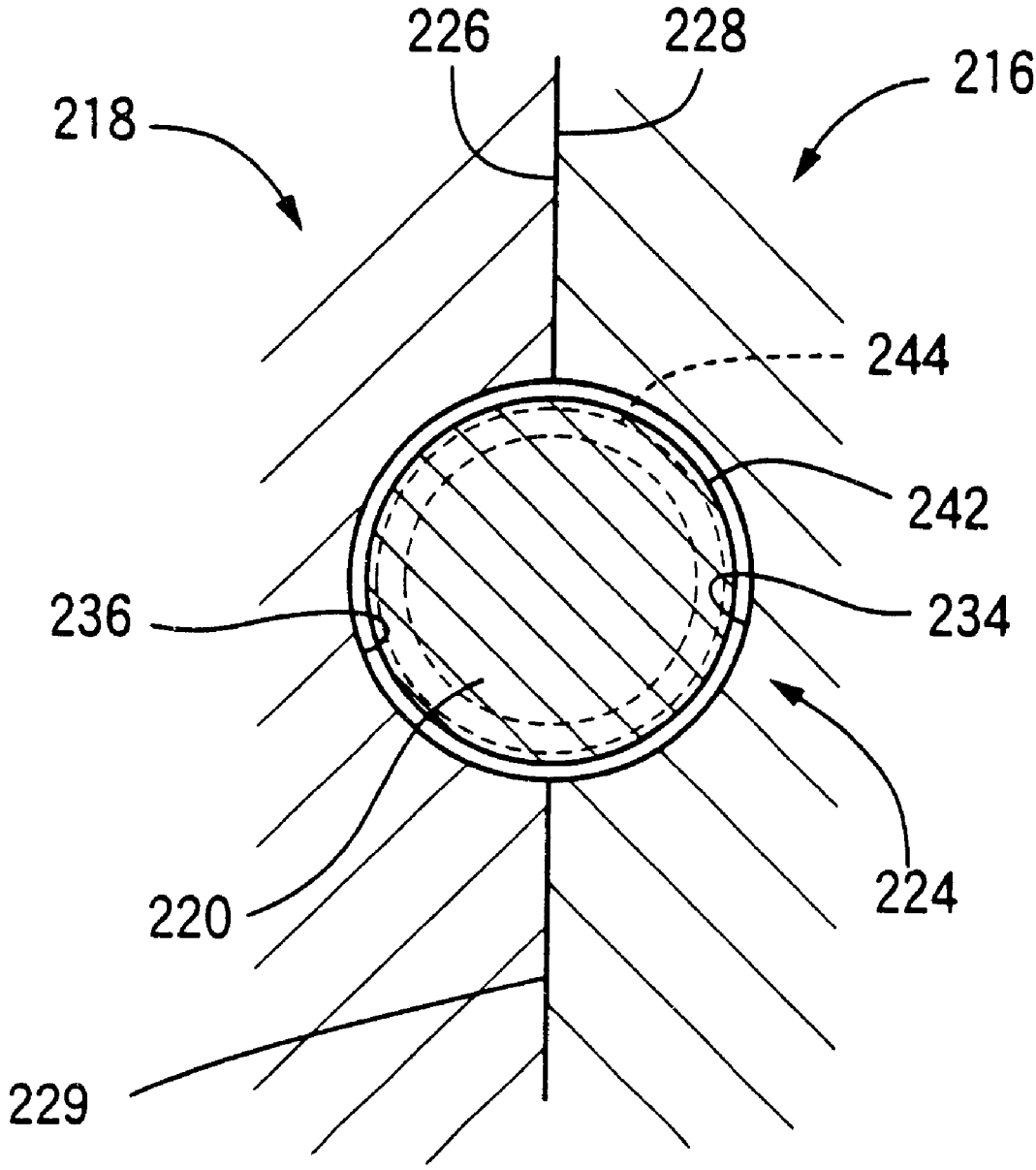
FIG. 6 is a side elevational view in cross section of a die-casting device used in the die-casting process as a step of the method of the present invention.

As indicated in FIG. 6, the parting plane 229 includes the centerline of the blank 160 passing the centers of the generally cylindrical head sections 170 and is parallel to the direction of extension of the arm sections 186, 188 from the base sections 184 of the engaging sections 166. As described above, the two mold halves 216, 218 have the respective molding surfaces 234, 236 which cooperate with the outer circumferential surfaces 242, 244 of the slide cores 220, 222, to define therebetween the mold cavity 224 whose profile follows that of the body member 162. The slide cores 220, 222 are disposed in the casting mold consisting of the two mold halves 216, 218, such that the slide cores 220, 222 are advanced into and retracted out of the casting mold by a suitable drive device (not shown). The slide cores 220, 222 indicated in the two-dot chain line in FIG. 4 are slidably movable in a direction parallel to the centerline of the cylindrical head sections 170 and in a direction perpendicular to the parting direction described above. The drive device for driving the slide cores 220, 222 include hydraulically operated cylinders, for example. Each slide core 220, 222 is movable between an advanced position in which the outer circumferential surface of each slide core 220, 222 cooperates with the molding surfaces 234, 236 of the two mold halves 216, 218 to define the molding cavity 224, and a retracted position in which a front end portion of each slide core 220, 222 is located outside the casting mold. The front end portion of each slide core 220, 222 has a configuration which gives the inner circumferential surface of the head section 170. The outer circumferential surface of each slide core 220, 222 is divided into two sections, i.e., a large-diameter section 242 whose diameter corresponds to that of the large-diameter portion 174 of the head section 170 and a small-diameter section 244 whose diameter corresponds to that of the small-diameter portion 176 of the head section 170.

Figures 5A, 5B, 5C:
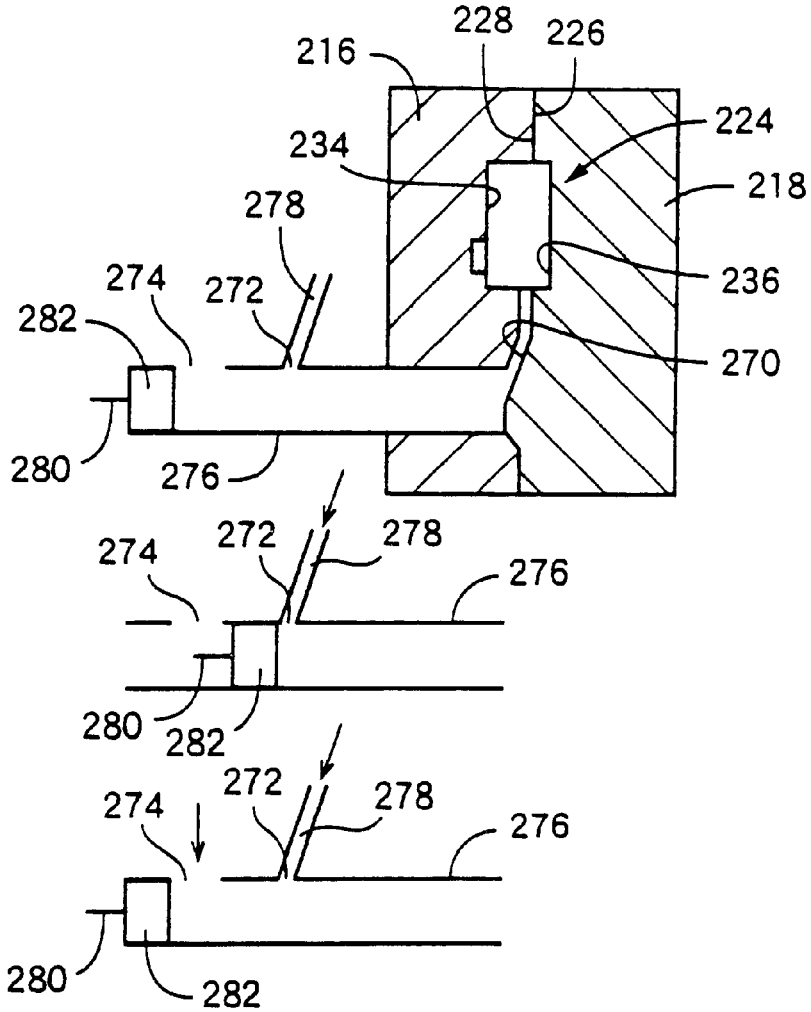

As shown in FIGS. 5A~5C, the lower end of the mold cavity 224 is held in communication with a sleeve 276 via a runner 270. The sleeve 276 is provided with an $O_2$ inlet 272 and a molten metal inlet 274. The runner 270 has a gate (not shown) provided at one of its opposite open ends on the side of the mold cavity 224. This gate has a diameter smaller than the other portion of the runner 270. The runner 270 is held in communication with the sleeve 276 at the other open end. The $O_2$ inlet 272 is provided in the sleeve 276 such that it is located nearer to the casting mold than the molten metal inlet 274. The $O_2$ inlet 272 is selectively connected and disconnected to and from an $O_2$ supply device or an $O_2$ supply source (not shown) via an $O_2$ supply passage 278. A molten metal (a molten aluminum alloy in the present embodiment) is injected through the molten metal inlet 274 into the sleeve 276. The sleeve 276 is a cylindrical member which extends through the mold half 216 so that one of its opposite end portions remote from the mold cavity 224 is located outside the casting mold. The $O_2$ inlet 272 and the molten metal inlet 274 are provided on the side of the above-indicated one end portion of the sleeve 276 located outside the casting mold. A plunger chip 282 formed at one end of a plunger 280 and having a diameter larger than that of the plunger 280 is slidably fitted in the sleeve 276. The plunger 280 is fixed to a piston of a plunger drive device in the form of a hydraulically operated cylinder (not shown) such that the plunger 280 is movable together with the piston. The above-indicated casting mold moving device, $O_2$ supply device, slide core drive device, and die-casting device including the plunger drive device are controlled by a control device (not shown). When the plunger chip 282 is in a retracted position shown in FIG. 5A, the molten metal inlet 274 is open for permitting the molten metal to flow therethrough into the sleeve 276.

When the plunger chip 282 is in the retracted position shown in FIG. 5A, the two mold halves 216, 218 are butted together at the parting plane 229 so that the two mold halves 216, 218 are inhibited from moving relative to each other. In this state, each slide core 220, 222 is advanced into the two mold halves 216, 218, so that the mold halves 216, 218 and the slide cores 220, 222 wait for the casting of the molten metal. Subsequently, the plunger chip 282 is advanced past the molten metal inlet 274 and is stopped at an advanced position before it reaches the $O_2$ inlet 272, as shown in FIG. 5B, so that the mold cavity 224 formed in the casting mold is inhibited from communicating with the atmosphere. In this state, an oxygen as a reactive gas is supplied through the $O_2$ inlet 272, so as to fill the mold cavity 224. Namely, the atmosphere in the mold cavity is substituted with the oxygen. Thereafter, the plunger chip 282 is placed in its retracted position with the oxygen being supplied through the $O_2$ inlet 272 into the sleeve 276, as shown in FIG. 5C. In this state, the molten metal is introduced into the sleeve 276 through the molten metal inlet 274. Subsequently, the plunger chip 282 is advanced at a high speed toward the casting mold, so that the level of the molten metal in the sleeve 276 is raised, whereby the molten metal is introduced into the runner 270, and then jetted into the mold cavity 224 through the narrow gate provided at the end of the runner 270. The oxygen in the mold cavity 224 reacts with the aluminum, and the mold cavity 224 is placed in a vacuum state in the absence of the oxygen, for thereby preventing the air, especially, nitrogen, from being trapped in the molten metal. Accordingly, the molten metal can easily flow through the mold cavity 224 which is defined by and between the molding surfaces 234, 236 of the two mold halves 216, 218 and the outer circumferential surfaces of the slide cores 220, 222 and which has a relatively small radial dimension corresponding to the small cylindrical wall thickness of the head section 170. The outer circumferential surface of each slide core 220, 222 gives the inner circumferential surface 172 of the head section 170 while the front end of the slide core 220, 222 gives an inner bottom surface 246 of the head section 170. An amount of gas included in the material of the body member 162 formed by the pore-free die-casting method is not more than 3 cc/100 g under a normal state, i.e., one atmospheric pressure and room temperature.

Since the molten metal is jetted through the narrow gate into the mold cavity 224, in the form of a fine mist, the molten metal is rapidly cooled after reaction with the oxygen, so that the solidified body member 162 has a chilled layer having a relatively large thickness. A chilled layer formed by the conventional die-casting method generally has a thickness of about 20 $\mu$m whereas the chilled layer formed by the present pore-free die-casting method has a thickness in the range of 40 to 50 $\mu$m. The chilled layer is characterized by a discontinuous change in the crystallization ratio of the primary crystal or $\alpha$-phase (proeutectic) and the eutectic silicon with respect to each other. Since the chilled layer has high values of hardness and strength, the presence of the chilled layer as the superficial portion of the body member 162 is effective to increase the strength of the head section 170 while reducing its wall thickness.

The movable mold half 218 is separated away from the stationary mold half 216, and the slide cores 220, 222 are retracted out of the formed head sections 170 a predetermined time after the molten metal was injected into the mold cavity 224. Then, the formed body member 162 is removed from the stationary mold half 218.

Like the body member 162, each closing member 164 is formed by the pore-free die-casting method, so that an amount of gas included in the material of the each closing member 164 is not more than 3 cc/100 g under the normal state, i.e., one atmospheric pressure and room temperature.

As shown in FIG. 3, each closing member 164 is fitted into the open end of the hollow head section 170 such that the annular fitting protrusion 192 of the closing member 164 engages the large-diameter portion 174 of the inner circumferential surface 172 of the head section 170. The closing member 164 is inserted into the hollow head section 170 such that the shoulder 194 of the closing member 164 is held in abutting contact with the annular end face 180 of the head section 170, and such that the shoulder 178 of the head section 170 is held in abutting contact with the annular end face 196 of the fitting protrusion 192 of the closing member 164. In the present embodiment, since the body member 162 and the each closing member 164 are both formed by die-casting and have a high dimensional accuracy, the closing members 164 are fitted in the body member 162 without prior mechanical working operations such as machining and grinding operations, resulting in a reduced cost of manufacture of the blank 160 for the single-headed pistons 14.

In the state in which the closing member 164 is fitted in the body member 162, the annular end face 180 of the head section 170 and the shoulder 194 of the closing member 164 are held in contact with each other, and the end face 180 and the shoulder 194 are welded to each other by electronic welding as a sort of beam welding. Thus, the end face, 180 and the shoulder 194 provide welding surfaces. This is the step of welding the body member 162 and the closing member 164 to each other, and will be described in detail below. An electronic-beam emitting device of an electronic-beam welding machine (not shown) emits an electronic beam toward a welding line which is defined by the respective circumferences of the above-indicated welding surfaces held in contact. As indicated at two-dot chain line in FIG. 3, a jig 250 having a fitting hole which can fit on the holding portion 202, is applied to each of the two closing members 164, so that the closing members 164 are pressed against the corresponding head sections 170. Thus, the body member 162 and the two closing members 164 are sandwiched by, and between, the two jigs 250. In this state, a rotating device (not shown) rotates the body member 162 and the closing members 164 altogether via the jigs 250, while the electronic beam, indicated at broken arrow in FIG. 3, is emitted toward the welding line. Thus, the beam spot formed by the electronic beam is moved on the above-indicated welding line, in the circumferential direction of the blank 160, so that respective portions of the body member 162 and the closing members 164, around the welding line, are welded to each other, that is, the closing members 164 are bonded to the body member 162. Since the jigs 250 prevent the closing members 164 from being fitting in the body member 162 such that a substantial space is left between each end face 180 and the corresponding shoulder 194, the body member 162 and the closing members 164 can be accurately welded to each other. In the present embodiment, the electronic welding is performed in a vacuum space.

Figure 7:
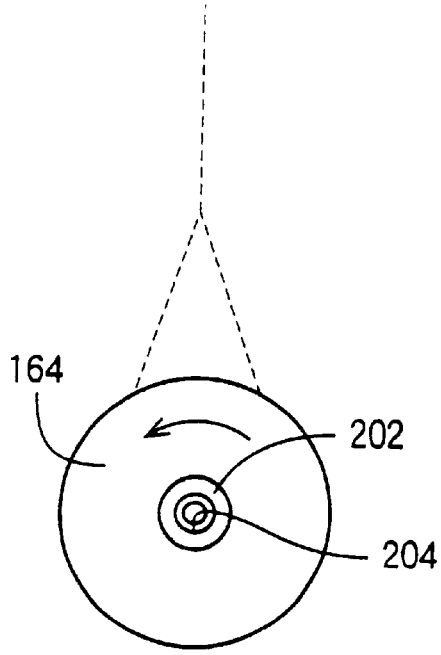
FIG. 7 is a view for explaining the welding step as a step of the method of the present invention.
Figure 8:
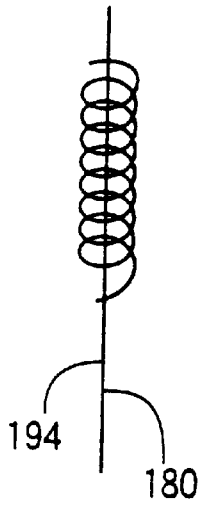
FIG. 8 is another view for explaining the welding step.

As shown in FIG. 7, the electronic beam emitted by the electronic-beam emitting device is bifurcated into two beams, each of which forms a beam spot at different positions on the welding line. As the body member 162 and the closing members 164 are rotated, each of the two electronic beams is moved at a predetermined speed on the welding line which extends in the circumferential direction of the body member 162. While each of the two beams is moved on the welding line, the each beam is iteratively rotated to describe a conical surface, so that the beam spot formed by the each beam is moved to describe the locus shown in FIG. 8. This rotation of the each electronic beam can be said as an example of the oscillation of electric beam relative to the welding line. In the present embodiment, each of the two electronic beams bifurcated from the single electronic beam emitted by the electronic-beam emitter, forms the beam spot which is moved, as the blank 16 is rotated by 360 degrees, along the welding line to describe the locus shown in FIG. 8 until the beam spot makes one full rotation around the circumference of the blank 160. Since the beam spot formed by each of the two, bifurcated electronic beams is moved along the welding line to describe the locus shown in FIG. 8, each point or spot on the welding line is exposed, two or more times, to the each bifurcated beam. In addition, since the each spot on the welding line is exposed to first one, and then the other, of the two bifurcated beams, the each spot on the welding line is subjected to two or more exposures to the electronic beam emitted by the electronic-beam emitter. That is, the electronic beam emitted by the electronic-beam emitter is applied, two or more times, to each spot on the welding line.

In the welding step, the body member 162 and the closing members 14 are welded to each other while respective welding portions of the members 162, 164 are molten and bonded to each other and the gas included in the material of those welding portions are heated and expanded to run away into the atmosphere. Thus, blowholes are produced in the welding beads. In the present embodiment, the body member 162 and the losing members 164 are produced, bye the above-described pore-free method, such that the amount of gas included in the material of the members 162,164 is at a low level. Therefore, the blowholes included in the welding beads are also at a low level. In addition, since the electronic beam emitted by the electronic-beam emitter is applied two or more times, to each spot on the welding line, as described above, the blowholes which are produced in the welding beads because of the first exposure of the each spot to the electronic beam, are closed by the second exposure because the welding beads are molten. Thus, the amount of blowholes produced in the welding beads are still reduced. In the present embodiment, the respective intensities of the two, bifurcated electronic beams are equal to each other. Depending upon the intensity of each of the electronic beams, the speed at which the each electronic beam is moved (i.e., the speed at which the rotating device rotates the blank 160) is so determined as to be suitable for appropriately melting the respective welding portions of the body member 162 and the closing members 164. In addition, the distance between the respective spots formed by the two electronic beams is determined at such a value which assures that after the respective welding portions of the members 162, 164, molten by one of the Two electronic beams, are solidified to an appropriate degree, the other electronic beam is applied to the welding portions to eliminate the blowholes.

After the two closing members 164 are fixedly fitted in the respective open end portions of the body member 162 as described above, a machining operation is performed on the outer circumferential surfaces of the hollow head sections 170 which give the head portions 72 of the two pistons 14, respectively, and the exposed outer circumferential surfaces of the closing members 164. This machining operation is effected on a lathe or turning machine such that the blank 160 is held by chucks at the holding portions 202 of the closing members 164, with the blank 160 being centered with two centers engaging the center holes 204, and such that the blank 160 (i.e., an assembly of the body member 162 and the two closing members 164 fitted in the body member 162) is rotated by the rotating device (i.e., a rotary drive device) through the chucks.

Then, the outer circumferential surfaces of the hollow head sections 170 of the body member 162 and the closing members 164 are coated with a suitable material, such as a film of polytetrafluoroethylene. The blank 160 is then subjected to a machining operation to cut off the holding portions 202 from the outer end faces 200 of the closing members 164, and a centerless grinding operation on the coated outer circumferential surfaces of the hollow head sections 170 and the closing members 164, so that the two portions which provide the head portions 72 of the two pistons 14 are formed. In the next step, a cutting operation is performed on the two bridge portions 182 of the twin engaging section 168, to form the recesses 114 (shown at a two-dot chain line in FIG. 3) in which the shoes 76 are received. Thus, the two portions which provide the engaging portions 70 of the two pistons 14 are formed at the twin engaging section 168. Finally, the twin engaging section 168 is subjected at its axially central portion to a cutting operation to cut the blank 160 into two pieces which provide the respective two single-headed pistons 14.

In the present embodiment, the respective welded portions of the head sections 170 and the closing members 164 have only a small amount of blowholes, and accordingly the bonding strength with which each of the head sections 170 and the corresponding one of the closing members 164 is improved. Thus, the pistons 14 which satisfy the required bonding strength and is suitable for practical use can be obtained.

In the present embodiment wherein the body member 162 is die-cast using the die casting device which includes the two mold halves 216, 218 and the slide cores 220, 222, the die-cast body member 162 need not be subjected to a machining operation on the inner circumferential surface 172 and the inner bottom surface 246 of each head section 170, resulting in a reduced cost of manufacture of the body member 162. However, the slide cores may be eliminated.

Figure 9:
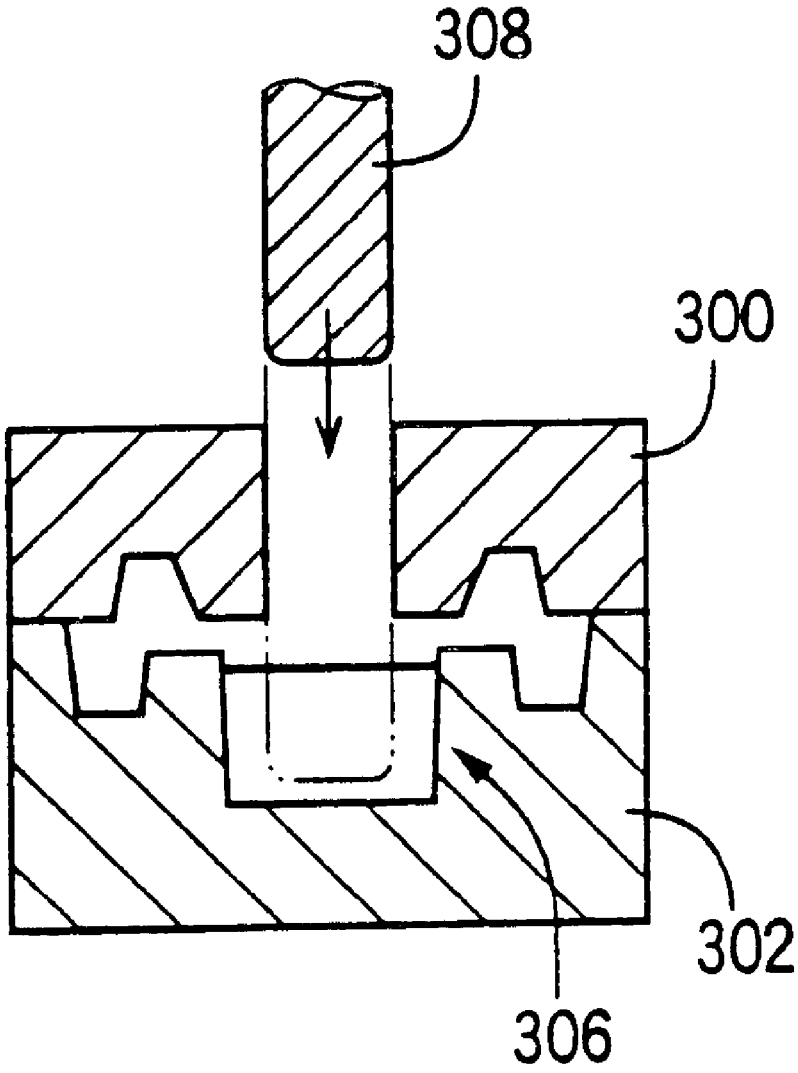
FIG. 9 is a front elevational view for explaining a casting step employed in another compressor-piston producing method as a second embodiment of the present invention.

Meanwhile, the body member 162 may be formed by forging-cast method. The forging-cast step is another example of the casting step. FIG. 9 schematically shows a device which is used for the forging-cast method. This device includes a pair of dies 300, 302 which can be opened and closed and which cooperate with each other to define an inner cavity 306 having a shape corresponding to the body member 162. The forging-cast device additionally includes a pressing member 308 which is movable in a direction in which the two dies 300, 302 are opened and closed, More specifically described, a drive device (not shown) moves the pressing member 308 to an advanced position inside the cavity 306 and a retracted position away from the cavity 306. After a fully or half molten metal (i.e., and aluminum alloy) is cast into the cavity 306, the pressing member 308 is advanced, so that a high pressure (i.e., 30 to 200 MPa) is applied to the molten metal, which is supplied to the whole of the cavity 306. Thus, the molten metal is solidified under the high pressure. The closing members 164 may also be formed by the forging-cast method. The forging-cast method can also produce the body member 162 and the closing members 164 such that the amount of gas included in the material of the members 162, 164 is at a low level, i.e., not more than 5 per 100 g of the material under the normal condition, i.e., lone atmospheric pressure and room temperature. Therefore, the respective welded portions of the body member 162 and the closing members 164 include only a small amount of blowholes which leads to improving the bonding strength.

The inner circumferential surface of the body member 162 may be a simple cylindrical surface. In this case, the fitting protrusion 192 of the closing member 162 is fitted in the inner cylindrical surface of the body member 162, to such a degree or depth that the end face 180 of the body member 162 and the shoulder 194 of the closing member 164 are held in abutting contact with each other.

The two, bifurcated electronic beams may be modified such that the two beams have different intensities. For example, the second one of the Two beams that forms the following beam spot on the welding line may have a higher intensity than that of the, first beam that forms the preceding beam spot. In this case, the first beam melts the welding portions to such a degree that the blowholes are eliminated, and the second, stronger beam properly melts the welding portions. Thus, the final products have only a small amount of blowholes.

The oscillation of each of the two bifurcated electronic beams may be effected by zigzagging of the each beam along the welding line, reciprocation of the each beam on the welding line, or the combination of zigzagging and reciprocation. Otherwise, it is possible that one of the two electronic beams be oscillated and the other beam be just moved on the welding line, or it is possible that each of the two electronic beams be just moved on the welding line. Moreover, it is possible that a single electronic beam be used to form a single beam spot on the welding line and be moved two or more times on each spot or point on the welding line. In the last case, the single beam may be just moved on the welding line, or be oscillated along the line.

In the embodiment shown in FIGS. 1 to 8, the blank 160 is rotated relative to each of the two, bifurcated electronic beams, so that the each beam is moved in the circumferential direction of the blank 160. However, the electronic-beam emitter or the beam spot formed by the electronic beam may be rotated relative to the blank 160.

FIGS. 10 to 14 show a third embodiment of the present invention. The compressor-piston producing method as the third embodiment may be employed as a method of producing a single-headed piston which is used in a swash plate type compressor as shown in FIG. 1. Accordingly, the same reference numerals as used in the first embodiment shown in FIGS. 1 to 8 are used to designate the corresponding elements and parts of the third embodiment, and the description thereof is omitted.

Figure 10:
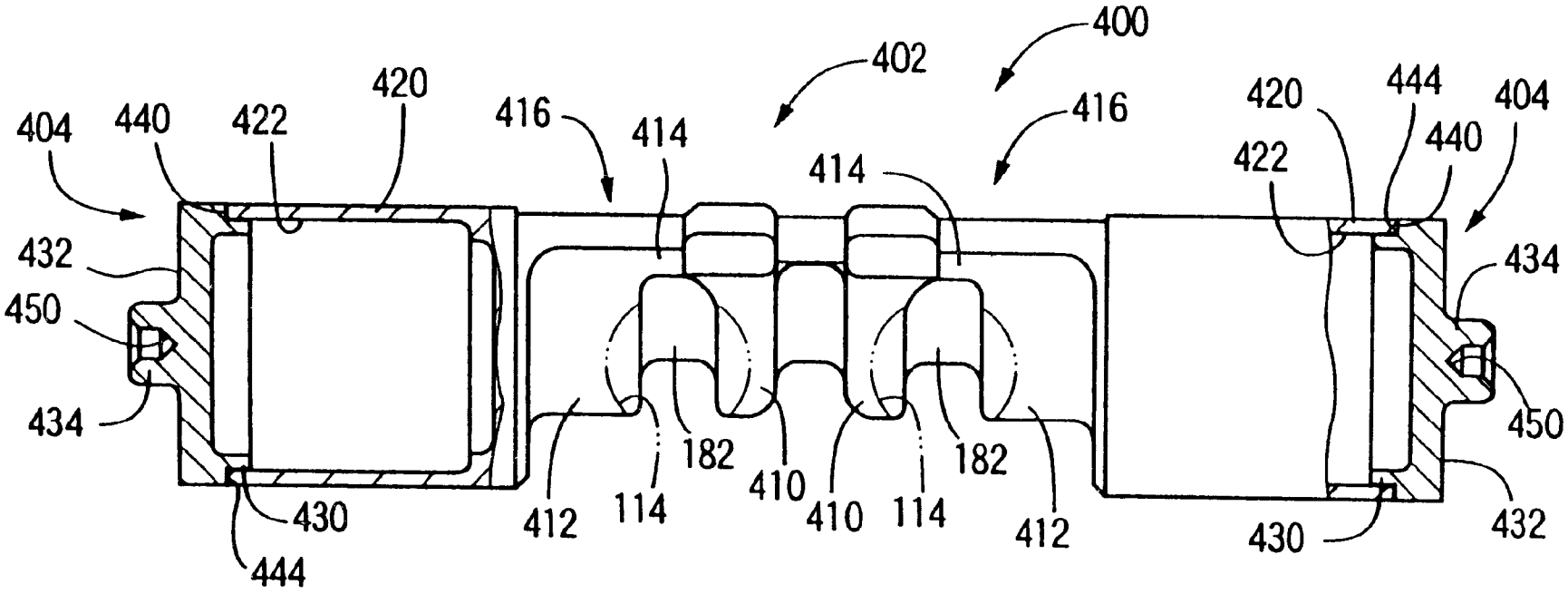
FIG. 10 is a partly cross-sectioned, front elevational view of a blank used in another compressor-piston producing method as a third embodiment of the present invention.
Figure 12:
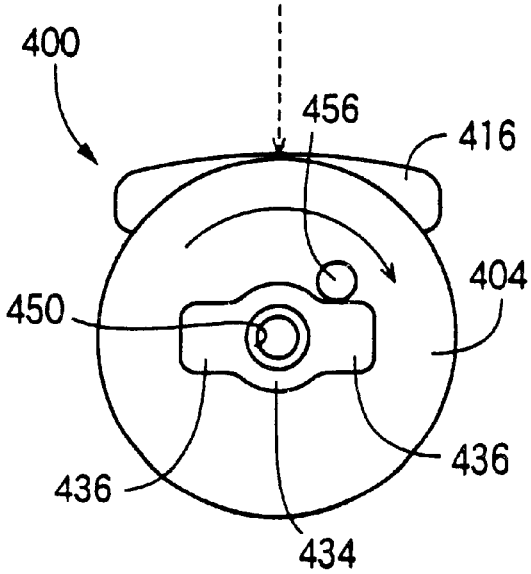
FIG. 12 is a side elevational view for explaining the welding step.

As shown in FIG. 10, a blank 400 used for producing a single-headed piston is, like the blank 160, a twin member including two connected portions corresponding to two single-headed pistons. That is, the blank 400 includes a body member 402, and two closing members 404 as cover members which just close respective open ends of the body member 402. The body member 402 includes, like the body member 162, two engaging portions 416 each of which includes a pair of arm sections 410, 412 and a connecting section 414 connecting between respective base portions of the two arm sections 410, 412; and two hollow cylindrical head sections 420 each of which is open at one of opposite ends thereof and is closed at the other end thereof that is integral with the arm section 412 of the corresponding engaging portion 416. The two engaging portions 416 of the body member 402 are integrally connected to each other, such that the respective open ends of the two head sections 420 open toward opposite directions, and such that the two head sections 420 are concentric with each other. Each of the two head sections 420 has an inner circumferential surface 422 having a simple cylindrical shape. Each of the two closing members 404 has, like each of the two closing members 164, a stepped cylindrical shape including a circular bottom wall and a small-diameter portion 430 which can be fitted in the inner cylindrical surface 422 of the corresponding head section 420. The closing member 404 has an end surface 432 which is opposite to the small-diameter portion 430 and from the center of which a projection 434 projects. As shown in FIG. 12, the projection 434 includes two ear portions 436 each of which has a generally rectangular cross-sectional shape and project in opposite directions from a central portion of the projection 434.

In the present embodiment, the body member 402 and the two closing members 404 are formed of an aluminum alloy as a sort of metal, in a casting step, by the previously-described pore-free method or the forging-cast method. Thus, the amount of gas included in the material of the body member 402 and the closing members 404 is as low as not more than 5 cc per 100 g of the material under the normal condition, i.e., one atmospheric pressure and room temperature. Since the pore-free method and the forging-cast method had been described in detail above, the description thereof is omitted.

The thus produced body member 402 and closing members 404 are bonded to each other by welding. In the state in which each of the two closing members 404 is positioned coaxial with the corresponding head section 420, the small-diameter portion 430 of the each closing member 404 is inserted into the open end of the head section 420, so that the small-diameter portion 430 is fitted in the inner circumferential surface 422 of the head section 420. Thus, the open end of the head section 420 is closed by the closing member 404, and an end face 440 of the head section 420 is held in abutting contact with a shoulder 444 which extends radially outward from the small-diameter portion 430 of the closing member 404. In this state, the head section 420 and the closing member 404 are bonded to each other by electronic-beam welding as a sort of beam welding. In this welding step, the end face 440 of the head section 420 and the shoulder 444 of the closing member 404 provide welding surfaces which are contacted with, and bonded to, each other. Hereinafter, the welding step will be described in detail below. As shown in FIG. 10, the projection 434 of each of the two closing members 404 has, at the center thereof, a center hole 450 which is formed in advance.

Figure 11:
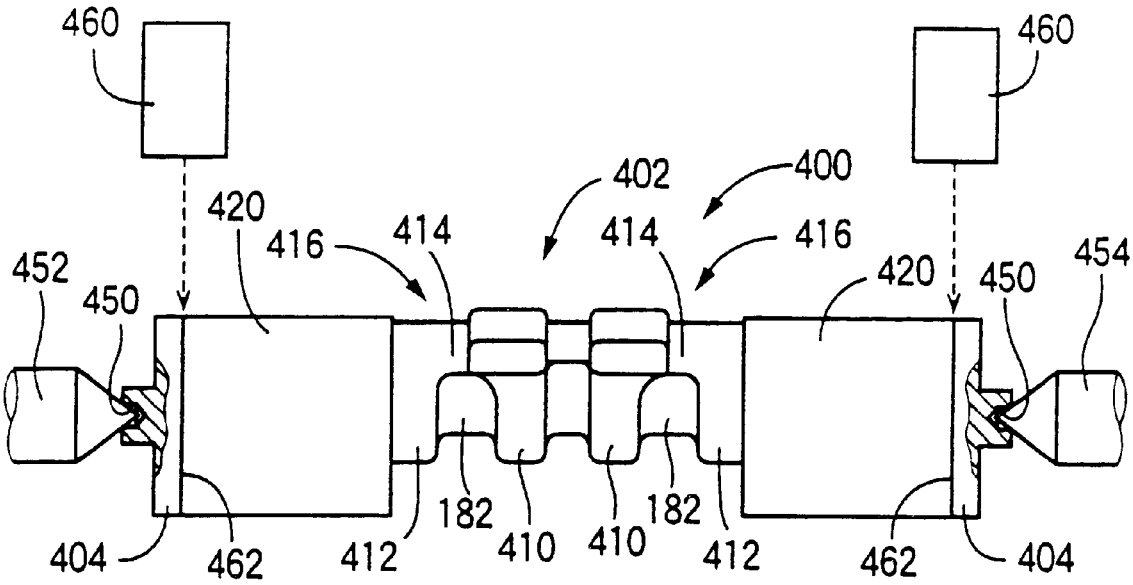
FIG. 11 is a partly cross-sectioned, front elevational view for explaining a welding step employed in the compressor-piston producing method.

As shown in FIG. 11, a pair of centering members 452, 454 are moved toward each other, and are engaged with the respective center holes 450 of the two closing members 404. Thus, the blank 400 is supported at opposite ends thereof by the two centering members 452, 454, such that the blank 400 is centered by the centering members 452, 454. A moving device (not shown) may be employed to Move the centering members 452, 454 in an axial direction of the blank 400. However, in the present embodiment, only one of the two centering members 452, 454 is moved toward the other, fixed centering member. In the centered state, a torque transmitting member 456 of a rotating device (or a rotary drive device, not shown) is positioned adjacent to one side surface of one of the two ear portions 436 of one closing member 404, as shown in FIG. 12. When the rotating device is operated, the rotation of the torque transmitting member 456, indicated at arrow in FIG. 12, is transmitted to the closing members 404 and the body member 402 because of the engagement of the member 456 with the ear portion 436. Then, an electronic-beam emitter 460 (schematically shown in FIG. 11) of an electronic-beam welding machine emits an electronic beam as a sort of welding beam (indicated at broken arrow in FIGS. 11 and 12) toward a welding line 462 (FIG. 11) which extends along the above-indicated welding surfaces (i.e., the end face 404 and the shoulder 444) in a circumferential direction of the blank 400. In the state in which the body member 402 and the two closing members 404 are sandwiched and held by the two centering members 452, 454, the two closing members 404 and the body member 402 are rotated by the rotating device while the electronic beam is emitted toward the welding line 462, so that the welding spot formed by the electronic beam is moved on the welding line 462 in the circumferential direction of the blank 400. As a result, respective portions of the members 402, 404 that are in the vicinity of the welding surfaces are molten, so that the members 402, 404 are, bonded to each other. Since the centering members 452, 454 effectively prevent the closing members 404 from being moved away from the body member 402, and accurately position the closing members 404 and the body member 402 relative to the electronic-beam emitter 460, the members 402, 404 are well welded to each other. The electronic-beam welding that is employed in the present embodiment is performed in a vacuum state. The centering-member moving device, the rotating device, and the electronic-beam welding machine including the beam emitter 460 are controlled by a control device (not shown).

In the present embodiment, since the beam spot formed by the electronic beam is moved around the blank 400, a plurality of times, along the welding line 462, each spot or point on the welding line 462 is subjected, the plurality of times, to the electronic beam. FIG. 13 shows a predetermined welding condition employed in the present embodiment. In the present embodiment, each spot on the welding line 462 is subjected, five times, to the electronic beam (in other words, the welding spot formed by the electronic beam is moved around the blank 400, five times), in such a manner that the magnitude of electric current used to emit the electronic beam is kept constant at the five times. Each spot on the welding line 462 is also subjected to the electronic beam in such a manner that a speed at which the electronic beam is moved (i.e., a speed at which the blank 400 is rotated by the rotating device) at each subsequent time out of the second to fourth times is higher than a speed at which the beam is moved at each prior time out of the first to third times that is prior to the each subsequent time, and that a speed at the second last (i.e., fourth) time is equal to a speed at the last time. More specifically described, the magnitude of electric current used to emit the electronic beam is kept at 50 mA, and the rotating device is controlled so that the speed of movement of the electronic beam is selected at 5 m/min for the first time, 7 m/min for the second time, 9 m/min for the third time, 11 m/min for the fourth time, and 11 m/min for the last (fifth) time.

Figure 14:
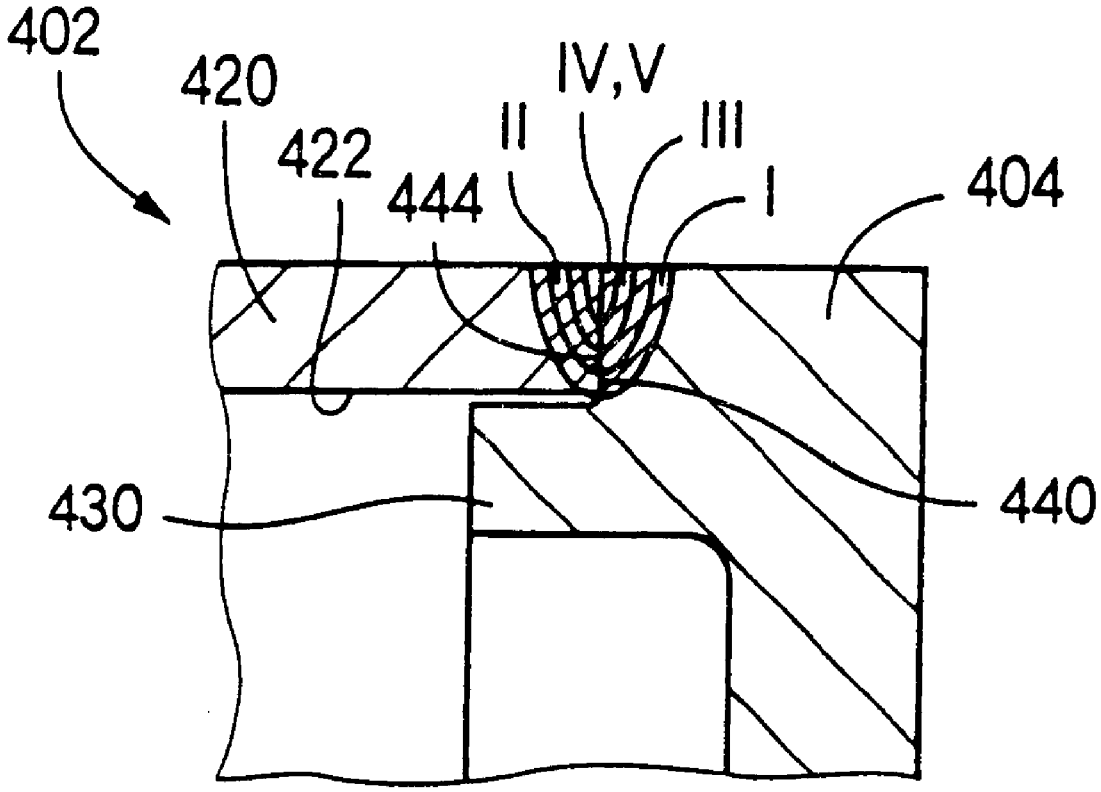
FIG. 14 is a partly cross-sectioned, front elevational view for explaining respective molten portions of the body member and the closing member that are welded to each other under the welding condition shown in the table of FIG. 13.

In the present embodiment, too, the pore-free die-cast method or the forging-cast method is employed to reduce the amount of gas included in the material of the body member 402 and the closing members 404 and form the welding beads including only a small amount of blowholes in addition, since each spot or point on the welding line 462 is subjected, a plurality of times, to the electronic beam as described above, the blowholes which may be produced in the welding beads at a prior one of the plurality of times, those blowholes are closed because those welding beads are molten by exposure to the electronic beam at a subsequent one of the plurality of times. Thus, the amount of blowholes left in the welding beads is further reduced. In particular, in the welding step of the present method, the speed of movement of the electronic beam is controlled or changed so that, as shown in FIG. 14, respective portions, II, III, IV, of The body member 402 and each closing member 404 that are molten, and bonded to each other, by the electronic beam at each subsequent time out of the second to fourth times are smaller than respective portions, I, II, III, of the body member 402 and the each closing member 404 that are molten, and bonded to each other, by the electronic beam at each prior time out of the first to third times that is prior to the each subsequent time. Therefore, at each of the second to fourth times, the electronic beam does not melt any new portion or portions of the members 402, 404. Thus, the predetermined welding condition shown in FIG. 13 assures that even if melting-related errors may be taken into consideration, the respective portions II, III, IV of the body member 402 and the each closing member 404 that are molten by the electronic beam at each subsequent time out of the second to fourth times are contained in the respective portions, I, II, III of the body member 402 and the each closing member 404 that are molten by The electronic beam at each prior time out of the first to third times that is prior to the each subsequent time. Thus, at the each subsequent time out of the second to fourth times, no new blowholes are produced from the gas included in the material of the members 402, 404, while the blowholes produced in the each prior time are effectively closed. Therefore, the body member 402 and the closing members 44 are bonded to other with an improved strength.

At the fourth and fifth times, the speed of movement of the electronic beam is kept constant. Therefore, the respective portions V of the body member 402 and the each closing member 404 that are molten by the electronic beam at the fifth time coincide with the respective portions IV of the body member 402 and the each closing member 404 that are molten by the electronic beam at the fourth time. However, the speed of movement of the electronic beam at the fifth time may be changed to be higher than that at the fourth time. In this case, the respective portions V of the body member 402 and the each closing member 404 that are molten by the electronic beam at the fifth time are smaller than the respective portions IV of the body member 402 and the each closing member 404 that are molten by the electronic beam at the fourth time. This modified method is covered by the present invention. However, in the case where the respective portions of the body member 402 and the each closing member 404 that are molten by the electronic beam at each time are gradually decreased as the first to fourth times shown in FIG. 14, if the total number of times each spot on the welding line 462 is exposed to the electronic beam increases, the difference between the respective portions of the body member 402 and the each closing member 404 that are molten at the first time and those molten at the last time accordingly increases. On the other hand, if the respective portions of the body member 402 and the each closing member 404 that are molten at each time become too small, the exposure to the electronic beam may not be said as effective To avoid this problem, it is need to take very large the respective portions of the body member 402 and the each closing member 404 that are molten at the first time. In view of this, it is desirable to keep constant the respective portions of the body member 402 and the each, closing member 404 that are molten at a portion of the plurality of times. Hence, in the present embodiment, the welding condition shown in FIG. 13 is the welding condition shown in FIG. 13 is predetermined to assure that the respective portions V of the body member 402 and the each closing member 404 that are molten by the electronic beam at the fifth time coincide with the respective portions IV of the body member 402 and the each closing member 404 that are molten by the electronic beam at the fourth time. More specifically described, the speed of movement of the electronic beam is controlled to be constant at the fourth and fifth times. Thus, even if the same speed may be kept at two successive times, the respective portions of the body member 402 and the each closing member 404 that are molten by the electronic beam at the subsequent one of the two time may coincide with the respective portions of the body member 402 and the each closing member, 404 that are molten by the electronic beam at a prior one of the two times. However, in a special case where the same speed is kept at the first and second times, the respective portions of the body member 402 and the each closing member 404 that are molten by the electronic beam at the second time may be larger than the respective portions of the body member 402 and the each closing member 404 that are molten by the electronic beam at the first time, because the temperature of the body member 402 and the closing members 404 has been largely increased from the room temperature by the exposure to the electronic beam at the first time. As the time os exposure to the electronic beam increase, the temperature of the body member 402 and the closing members 404 reaches a constant state with small increases only. Therefore, at the fourth and fifth times in the present embodiment, the change of temperature is so small that even if the speed of movement of the electronic beam may be kept constant, the respective portions V of the body member 402 and the each closing member 404 that are molten by the electronic beam at the fifth time, substantially coincide with the respective portions IV of the body member 402 and the each closing member 404 that are molten by the electronic beam at the fourth time. In this way, even at the last time, sufficiently large portions of the body member 402 and the each closing member 404 can be molten by the electronic beam, and accordingly blowholes can be well eliminated, so that end face 440 and the shoulder 444 can be strongly bonded to each other.

The predetermined welding condition shown in FIG. 13 may be replaced with a predetermined welding condition shown in FIG. 15, in a fourth embodiment of the present invention. In the fourth embodiment, the speed of movement of the electronic beam is kept constant at all times (e.g., five times) and as the times increase, the intensity of the electronic beam is gradually decreased. However, the intensity of the electronic beam employed at the second last (fourth) time is kept at the last (fifth) time. More specifically described, the speed of movement of the electronic beam is kept at 5 m/min at all the five times, and the electronic-beam emitter 460 of the electronic-beam welding machine is controlled by the control device such that the magnitude of electric current supplied to the electronic-beam emitter 460 is selected at 50 mA for the first time, 40 mA for the second time, 30 mA for the third time, and 20 mA for the fourth and fifth times. Thus, in the present embodiment, too, the body member 42 and the two closing members 404 are well welded to each other with only a small amount of blowholes being produced, like in the third embodiment shown in FIGS. 10 to 14.

However, in the case where the efficiency of the welding operation is improved, it is preferred to increase gradually the speed of movement of the electronic beam, like in the third embodiment. On the other hand, in the case where the cost of the welding machine is decreased by employing a rotating device (a rotary drive device) which is not capable of changing the speed at which the rotating device rotates the blank 400, it is preferred to decrease gradually the magnitude of electric current supplied to the electronic-beam emitter 460, like in the fourth embodiment.

Figure 16:
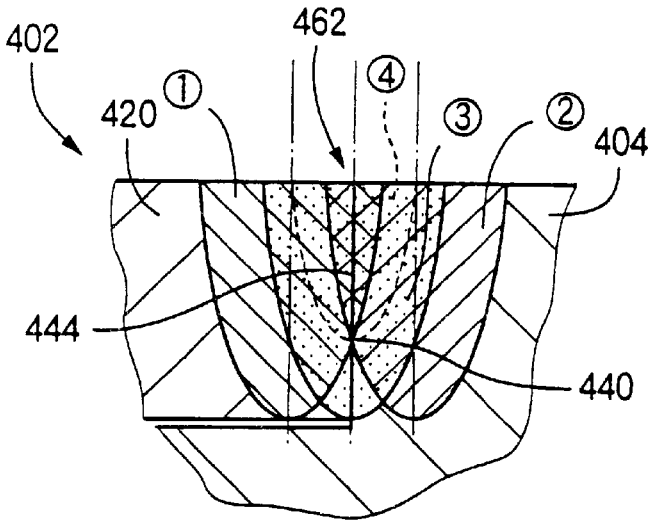
FIG. 16 is a partly cross-sectioned, front elevational view for explaining respective portions of the body member and the closing member that are molten in a welding step of another compressor-piston producing method as a fifth embodiment of the present invention.

The position of the center of the beam spot formed by the welding beam in the axial direction of the blank 400 may be changed relative to the welding line 462, when each spot on the welding line 462 is exposed, at a plurality of times, to the welding beam A fifth embodiment of the present invention, shown in FIG. 16, relates to this method. In the fifth embodiment, at the first time of four times, the position of the center of the electronic beam as a sort of welding beam is offset from the welding line 462 in a first direction perpendicular to the line 462, i.e., in the axial direction of the blank 400. At the second time, the position of the center of the electronic beam is offset from the welding line 462 in a second direction opposite to the first direction. At the third time, the position of the center of the electronic beam is located on the welding line 462. However, it is noted that in FIG. 16, the amount of offset of the welding beam from the welding line 462 is exaggerated for easier understanding purposes only. In FIG. 16, respective portions of the body member 402 and each closing member 404 that are molten by the welding beam at the first time are indicated at "①", respective portions of the body member 402 and the each closing member 404 that are molten by the welding beam at the second time are indicated at "②"; and respective portions of the body member 402 and the each closing member 404 that are molten by the welding beam at the third time are indicated at "③". The first portions "①", the second portions "②", and the third portions "③" overlap one another. Thus, respective welding portions of the body member 402 and the each closing member 404, including the end face 440 and the shoulder 444 as the welding surfaces, that is, each spot on the welding line 462, are exposed, a plurality of times (three times in the present embodiment), to the electronic beam, so that the welding portions are molten the plurality of times and the blowholes produced by the exposure to the electronic beam at the first or second time are closed or eliminated by the exposure to the electronic beam at the second or third time.

In The fifth embodiment, both the speed of movement of the electronic beam and the magnitude of electric current supplied to the electronic-beam emitter 460 are kept constant at the three times. Thus, the first portions "①", the second portions "②", and the third portions "③" have substantially the same width (i.e., the dimension in the first or second direction perpendicular to the welding line 462) and substantially the same depth in the radial direction of the black 400. Therefore, the electronic-beam welding machine can be easily controlled. However, a predetermined welding condition employed in the fifth embodiment requires that at the last (fourth) time, the speed of movement of the electronic beam be higher than that at the prior (first to third) times and/or the magnitude of electric current supplied to the emitter 460 be smaller than that at the prior times. At the last time, in the state in which the position of the center of the electronic beam is located on the welding line 462, the electronic beam is applied to the blank 400. According to this welding condition, respective portions, indicated at "④" and enclosed by broken line in FIG. 16, of the body member 402 and the each closing member 404 that are molten at the fourth (last) time are smaller than (i.e., are fully contained in) the sum of the first portions "①", the second portions "②", and the third portions "③" that are molten in the first to third time prior to the last time. Thus, at the last time, the electronic beam does not melt any new portions of the members 402, 404. Therefore, as explained in connection with the third embodiment shown in FIGS. 10 to 14, no new blowholes are produced by the exposure to the electronic beam at the last time, while the blowholes which have been produced in the first to third portions "①", "②", "③" at the prior times are effectively closed or eliminated. Consequently the,body member 402 and the each closing member 404 are bonded to each other with an improved strength. However, at the first to third times, at least one of the speed of movement of the electronic beam and the magnitude of electric current supplied to the emitter 460 may be so changed that the first to third portions "①", "②", "③" are accurately identical with one another.

Figure 17:
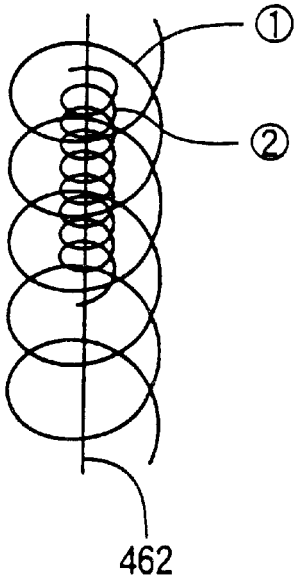
FIG. 17 is a view for explaining a welding step of another compressor-piston producing method as a sixth embodiment of the present invention.

The welding beam may be oscillated as explained in connection with the first embodiment shown in FIGS. 1 to 8, and the amount (or amplitude) of oscillation of the welding beam may be changed. A sixth embodiment shown in FIG. 17 relates to this modified method. In the sixth embodiment, the electronic beam as the welding beam is moved along the welding line 462 while the electronic beam is iteratively rotated along a conical surface to describe iteratively, a different conical surface, so that the beam spot formed by the electronic beam describes a locus shown in FIG. 17. This rotation or motion of the electric beam is defined as a sort of oscillation in accordance with the present invention. While the beam spot formed by the electronic beam runs, one time, along the entirety of the circumferential welding line 462, each spot or point on the welding line 462 are exposed, a plurality of times, to the electronic beams. In the welding step of the present method, the electronic beam runs, two times, along the entirety of the welding line 462. However, it is possible to move the electronic beam, three or more times, along the entirety of the welding line 462. In the welding step of the present method, the electronic beam is iteratively rotated, at the second time, to describe a locus, indicated at "②", which has a width (i.e., a dimension in the direction perpendicular to the welding line 462) smaller than that of a locus, indicated at "①", which is described by the iterative rotation of the electronic beam at the first time. In FIG. 17, the difference between the first and second loci "①", "②" is exaggerated for easier understanding purposes only. A predetermined welding condition employed in the sixth embodiment requires that at the second time, the speed of movement of the electronic beam be higher than that at the first time and/or the magnitude of electric current supplied to the emitter 460 be smaller than that at the first time. Thus, respective portions of the body member 402 and each closing member 404 that are molten by the electronic beam at the second time have a width and a depth which are not greater than those of respective portions of the body member 402 and the each closing member 404 that are molten by the electronic beam at the first time, so that at the second time, the electronic beam does not melt any new portions of the members 402, 404.

In each of the third to sixth embodiments shown in FIGS. 10 to 14, FIG. 15, FIG. 16, and FIG. 17, it is possible to employ two bifurcated electronic beams which are to be applied to different spots or points on the welding line, like in the first embodiment shown in FIGS. 1 to 8. In addition, the electronic beam may be oscillated. The oscillation, of the electronic beam may be effected in a first manner that the beam spot formed by the electronic beam describes a locus along the welding line like in the sixth embodiment shown in FIG. 17, a second manner that the electronic beam moves along the welding line while zigzagging across the welding line, a third manner in which the electronic beam iteratively moves forward and backward on the welding line, or a fourth manner in which two or more of the first to third manners are combined. In the case where the two bifurcated electronic beams are employed, it is possible to oscillate only one of the two beams and simply move the other beam along the welding line. Otherwise, it is possible to move simply both of the two beams along the welding line.

In each of the third to sixth embodiments shown in FIGS. 10 to 14, FIG. 15, FIG. 16, and FIG. 17, the blank 400 is rotated to move the beam spot formed by the electronic beam, relative to the blank 400 in the circumferential direction thereof. However, the electronic-beam emitter 460 or the beam spot formed by the electronic beam may be rotated or revolved relative to the blank 400.

The predetermined welding condition employed in each of the above-described embodiments may be modified so long as the respective portions of the body member 402 and the each closing member 404 that are molten by the electronic beam at the last time are contained in the sum of the respective portions of the body member 402 and the each closing member 404 that are molten by the electronic beam at each of all the prior times to the last time. That is, the total number of times each spot on the welding line is exposed to the electronic beam, the speed of movement of the electronic beam, the magnitude of electric current used to emit the electronic beam may be changed to various values. In addition, other welding conditions than the speed of movement of the electronic beam and the magnitude of electric current may be changed.

In the first embodiment shown in FIGS. 1 to 8, the jigs 250 may be replaced with a pair of centering members which are to engage respective center holes of the two engaging portions of the blank 160, like in the third embodiment shown in FIGS. 10 to 14, so that the blank 160 is supported at the opposite ends thereof by the two centering members and is rotated by the rotation transmitted thereto from a rotary drive device via a torque transmitting member. In this case, it is preferred that the engaging portions of the blank 160 include like the projections 434, two integral ear portions which extend, in opposite directions from the outer circumferential surface of a central circular portion thereof and which can be engaged with the torque transmitting member.

In each of the above-described embodiments, the welding step is carried out using the electronic beam in the vacuum state. Since, in the vacuum state, air does not expand due to heating, it is not needed to relieve air from the inner space of the body member 162, 402 closed by the closing members 164, 404. Accordingly, the piston 14 need not have any air-relief holes. However, the piston 14 may have one or more air-relief holes.

The configuration of each closing member 164, 404 is not particularly limited. For instance, the closing member may be a circular plate. In the illustrated embodiments, the closing members are produced by die-casting. The closing members may be produced by any other method such as forging. When the closing members have simple configurations such as those of the closing members 164, 404 in the illustrated embodiments, the closing members may be produced by effecting a machining operation on an ordinary cylindrical member which is commercially available.

The closing members 164, 404 may be welded to the body member 162, 402 by means of a laser beam. If the closing members are welded to the body member by means of the laser beam, the blank 160, 400 including the body member and the closing members fixed to the body member is not required to be placed in a vacuum state.

The parting plane which is defined by the two mold halves 216, 218 of the casting mold used for die-casting the blank for the two single-headed pistons may be otherwise established. For instance, the parting plane may be parallel to a plane which includes a centerline of the blank 160 passing the centers of the head sections 170 and which is perpendicular to the direction of extension of the arm sections 186, 188 from the base sections 184. In this case, the parting plane passes a portion of the engaging sections 166 which has the largest dimension as measured in the direction perpendicular to the direction of extension the arm sections 186, 188.

In the illustrated embodiments, two pieces of the single-head pistons are produced from a single blank wherein two engaging sections are connected to each other. However, two head sections, or one head section and one engaging section may be connected to each other to provide a blank for producing the two pieces of the pistons. The illustrated embodiments wherein two pieces of the pistons can be produced from a single blank are effective to reduce the cost of die-casting the pistons. However, a single piston may be produced from a single blank.

In the piston produced, in the illustrated embodiments, the engaging portion is integral with the head portion, and the closure member closes the open end of the head portion which is opposite to the engaging portion. The blank may be otherwise constructed. For instance, the engaging portion, which engages the drive device for driving the drive member in the form of the swash plate, may be integrally formed with the closure member by die-casting such as pore-free die-casting or forging-cast method. The thus formed engaging portion may be welded to a hollow head portion which is separately formed from the engaging portion by the pore-free die-casting or forging-cast method, with the open end of the head portion being closed by the closure member formed integrally with the engaging portion.

In the illustrated embodiments, the body member and the closing members are formed of an aluminum alloy. However, these members may be formed of other metallic material such as a magnesium alloy.

The construction of the swash plate type compressor for which the piston 14 is incorporated is not limited to that of FIG. 1. For instance, the solenoid-operated control valve 90 is not essential, and the compressor may use a shut-off valve which is mechanically opened and closed depending upon a difference between the pressures in the crank chamber 86 and the discharge chamber 24. In place of or in addition to the solenoid-operated control valve 90, a solenoid-operated control valve similar to the control valve 90 may be provided in the bleeding passage 100. Alternatively, a shut-off valve may be provided, which is mechanically opened or closed depending upon a difference between the pressures in the crank chamber 86 and the suction chamber 22.

The present invention is equally applicable to a piston used for a swash plate type compressor of fixed capacity type wherein the angle of inclination of a swash plate is fixed, and a double-headed piston having two head portions on the opposite sides of the engaging portion, for instance. Further, the present invention is applicable to a piston for a different type of compressor such as a wave cam type compressor.

While some preferred embodiments of this invention have been described above, for illustrative purpose only, it is to be understood that the present invention may be embodied with various changes and improvements such as those described in SUMMARY OF THE INVENTION, which may occur to a person skilled in the art.

What is claimed is:

1. A method of producing a piston for a compressor, comprising the steps of:

casting a molten material into a die to form a hollow cylindrical head portion of the piston that is open at one of opposite ends thereof and is closed at the other end thereof, such that an amount of gas included in the material of the head portion is not more than 5 cc per 100 g of the material, closing, with a closure member, the open end of the head portion; and welding the head portion and the closure member to each other by emitting, a plurality of times, a welding beam toward each of a multiplicity of spots on a welding line along which the head portion and the closure member contact each other.

2. A method according to claim 1, wherein the step of casting the molten material comprises casting the molten material in a pore-free die-cast method.

3. A method according to claim 1, wherein the step of casting the molten material comprises casting the molten material in a forging-cast method.

4. A method according to claim 1, wherein the step of welding the head portion and the closure member comprises welding the head portion and the closure member to each other by emitting each of a plurality of welding beams toward said each of the spots on the welding line while moving at least one of said each of the welding beams and a combination of the head portion and the closure member relative to the other of said each of the welding beams and said combination, so that said each of the spots is exposed to said each of the welding beams.

5. A method according to claim 4, wherein the step of emitting said each of the welding beams comprises oscillating at least one of the welding beams, relative to the welding line, while moving said one welding beam relative to said combination.

6. A method according to claim 5, wherein the step of oscillating said one welding beam comprises rotating said one welding beam so as to describe a conical surface.

7. A method according to claim 1, wherein the step of welding the head portion and the closure member comprises welding the head portion and the closure member to each other by emitting at least one welding beam toward said each of the spots on the welding line while moving at least one of said one welding beam and a combination of the head portion and the closure member relative to the other of said one welding beam and said combination, so that said each of the spots is exposed, said plurality of times, to said one welding beam.

8. A method according to claim 7, wherein the step of emitting said one welding beam comprises oscillating said one welding beam relative to the welding line while moving said one welding beam relative to said combination.

9. A method according to claim 1, wherein the step of welding the head portion and the closure member comprises welding the head portion and the closure member to each other under a predetermined welding condition which assures that respective portions of the head portion and the closure member that are molten by the welding beam at a last time of said plurality of times are contained in a sum of respective portions of the head portion and the closure member that are molten by the welding beam at each time of said plurality of times that is prior to said last time.

10. A method according to claim 9, wherein the predetermined welding condition assures that respective portions of the head portion and the closure member that are molten by the welding beam in each subsequent time of said plurality of times are contained in respective portions of the head portion and the closure member that are molten by the welding beam at each prior time of said plurality of times that is prior to said each subsequent time.

11. A method according to claim 9, wherein the predetermined welding condition assures that respective portions of the head portion and the closure member that are molten by the welding beam at said last time are contained in respective portions of the head portion and the closure member that are molten by the welding beam at a first time of said plurality of times that is prior to said last time.

12. A method according to claim 9, wherein the step of welding the head portion and the closure member to each other comprises emitting, at least three times including at least one time between a first time and said last time, the welding beam toward said each of the spots on the welding line, and wherein the predetermined welding condition assures that respective portions of the head portion and the closure member that are molten by the, welding beam at each of said at least one time are contained in respective portions of the head portion and the closure member that are molten by the welding beam at said first time.

13. A method according to claim 9, wherein the predetermined welding condition assures that respective portions of the head portion and the closure member that are molten by the welding beam at said last time coincide with respective portions of the head portion and the closure member that are molten by the welding beam at least one time of said plurality of times that precedes said last time.

14. A method according to claim 9, wherein the predetermined welding condition comprises that a speed at which at least one of the welding beam and a combination of the head portion and the closure member is moved relative to the other of the welding beam and said combination, at said last time, is equal to a speed at which said one of the welding beam and said combination is moved relative to the other of the welding beam and said combination, at least one time of said plurality of times that precedes said last time, and that an intensity with which the welding beam is emitted at said last time is equal to an intensity with which the welding beam is emitted at said at least one time.

15. A method according to claim 9, wherein the predetermined welding condition assures that respective portions of the head portion and the closure member that are molten by the welding beam at each subsequent time of said plurality of times are contained in respective portions of the head portion and the closure member that are molten by the welding beam at each prior time of said plurality of times that is prior to said each subsequent time, and wherein the predetermined welding condition comprises at least one of (a) that a speed at which at least one of the welding beam and a combination of the head portion and the closure member is moved relative to the other of the welding beam and said combination, at said each subsequent time, is not lower than a speed at which said one of the welding beam and said combination is moved relative to the other of the welding beam and said combination, at said each prior time, and (b) that an intensity with which the welding beam is emitted at said each subsequent time is not higher than an intensity with which the welding beam is emitted at said each prior time.

16. A method according to claim 9, wherein the predetermined welding condition assures that respective portions of the head portion and the closure member that are molten by the welding beam at Leach subsequent time of said plurality of times are contained in respective portions of the head portion and the closure member that are molten by the welding beam at each prior time of said plurality of times that is prior to said each subsequent time, and wherein the predetermined welding condition comprises that an amount of oscillation of the welding beam relative to the welding line at said each subsequent time is less than an amount of oscillation of the welding beam relative to the welding line at said each prior time.

* * * * *